US010927433B2

(12) United States Patent
Amaratunga et al.

(10) Patent No.: US 10,927,433 B2
(45) Date of Patent: Feb. 23, 2021

(54) METHOD OF PRODUCING TITANIUM FROM TITANIUM OXIDES THROUGH MAGNESIUM VAPOUR REDUCTION

(71) Applicant: Sri Lanka Institute of Nanotechnology (PVT) Ltd., Malwana (LK)

(72) Inventors: Gehan Amaratunga, Pitipana (LK); Niranjala Fernando, Pitipana (LK); Gayan Priyadarshana, Pitipana (LK); Veranja Karunaratne, Pitipana (LK); Nilwala Kottegoda, Pitipana (LK)

(73) Assignee: Sri Lanka Institute of Nanotechnology (PVT) Ltd., Walgama (LK)

( * ) Notice: Subject to any disclaimer, the term of this patent is extended or adjusted under 35 U.S.C. 154(b) by 334 days.

(21) Appl. No.: 15/946,794

(22) Filed: Apr. 6, 2018

(65) Prior Publication Data

US 2018/0223393 A1 Aug. 9, 2018

Related U.S. Application Data

(63) Continuation-in-part of application No. 15/226,763, filed on Aug. 2, 2016, now Pat. No. 10,316,391.

(51) Int. Cl.

| | |
|---|---|
| ***C22B 34/12*** | (2006.01) |
| ***C22B 5/12*** | (2006.01) |
| ***C22B 7/00*** | (2006.01) |

(52) U.S. Cl.

CPC ..... *C22B 34/129* (2013.01); *C22B 5/12* (2013.01); *C22B 7/007* (2013.01); (Continued)

(58) Field of Classification Search

CPC ..... C22C 34/129; C22C 34/126; C22C 34/08; C22C 34/204; C22C 34/124; C22C 5/12; C22C 7/007

See application file for complete search history.

(56) References Cited

U.S. PATENT DOCUMENTS

| | | | |
|---|---|---|---|
| 1,602,542 | A | 10/1926 | Marden et al. |
| 2,205,854 | A | 6/1940 | Kroll |

(Continued)

FOREIGN PATENT DOCUMENTS

| | | |
|---|---|---|
| GB | 664061 A | 1/1952 |
| GB | 675933 | 7/1952 |

(Continued)

OTHER PUBLICATIONS

Fang, Zhigang Zak, et al., "A New, Energy-Effcient Chemical Pathway for Extracting Ti Metal from Ti Minerals", *Journal of American Chemical Society*, Nov. 20, 2013, pp. 18248-18251, ACS Publications, US.

(Continued)

*Primary Examiner* — C Melissa Koslow
(74) *Attorney, Agent, or Firm* — Alston & Bird LLP

(57) ABSTRACT

Disclosed herein is a novel approach to the chemical synthesis of titanium metal from a titanium oxide source material, such as a mineral comprising titanium. In the approach described herein, a titanium oxide source is reacted with Mg vapor to extract a pure Ti metal. The method disclosed herein is more scalable, cheaper, faster, and safer than prior art methods.

19 Claims, 28 Drawing Sheets
(20 of 28 Drawing Sheet(s) Filed in Color)

(52) U.S. Cl.
CPC ..... *C22B 34/1204* (2013.01); *C22B 34/124* (2013.01); *C22B 34/1268* (2013.01)

(56) References Cited

U.S. PATENT DOCUMENTS

| | | | |
|---|---|---|---|
| 2,834,667 | A | 5/1958 | Rostron |
| 3,140,170 | A | 7/1964 | Henrie et al. |
| 6,171,363 | B1 | 1/2001 | Shekhter et al. |
| 10,316,391 | B2 * | 6/2019 | Abayaweera ..... C22B 34/1277 |
| 2010/0288649 | A1 | 11/2010 | Pal |
| 2011/0123822 | A1 | 5/2011 | Gille et al. |
| 2013/0164167 | A1 | 6/2013 | Cox et al. |
| 2016/0194733 | A1 | 7/2016 | Fang et al. |
| 2018/0037974 | A1 | 2/2018 | Abayaweera et al. |

FOREIGN PATENT DOCUMENTS

| | | | |
|---|---|---|---|
| JP | S30-5315 | B | 8/1953 |
| JP | 2002-544375 | A | 12/2002 |
| JP | 2003-105457 | * | 4/2003 |
| JP | 2003-105457 | A | 4/2003 |
| JP | 2005-089830 | A | 4/2005 |
| JP | 2005-194554 | A | 7/2005 |
| JP | 2010-537040 | A | 12/2010 |
| WO | WO 1999/64638 | A1 | 12/1999 |
| WO | WO-2000/067936 | A1 | 11/2000 |
| WO | WO-2009/021820 | A1 | 2/2009 |

OTHER PUBLICATIONS

International Searching Authority, International Search Report and Written Opinion for International Application No. PCT/IB2017/054541, dated Nov. 13, 2017, 10 pages, Korean Intellectual Property Office, Republic of Korea.

Ismail, M., et al., "The upgrading of ilmenite from Sri Lanka by the oxidation-reduction-leach process", *International Journal of Mineral Processing*, Mar. 1983, pp. 161-164, vol. 10, issue 2, Elsevier, Netherlands.

Okabe, H., et al., "Titanium powder production by preform reduction process (PRP)", *Journal of Alloys and Compounds*, Feb. 2004, pp. 156-163, vol. 364, Elsevier, Netherlands.

www.alibaba.com, Jan. 25, 1999 to May 2, 2018, Internet Archive https://webarchive.org/web/*/http://www.alibaba.com, 7 pages.

www.lankamineralsands.com/index.php/products, Jan. 5, 2015 to Oct. 11, 2017, Internet Archive https://web.archive.org/web/*/http://www.lankamineralsands.com/index.php/products.

Extended European Search Report for European Application 17536487.3 dated Jan. 2, 2020.

H.H. Nersisyan et al. "Direct magnesiothermic reduction of titanium dioxide to titanium powder through combustion synthesis", Chemical Engineering Journal, vol. 235, Jan. 1, 2014, p. 67-74.

M R Sc et al. "Synthesis of Titanium via Magnesiothermic Reduction of TiO2 (Pigment)", Retrieved from the Internet: URL:http://www.metallurgie.rwth-aachen,de/new/images/pages/publikationen/bolivaer_r_ime_id_5303.pdf [retrieved on Dec. 6, 2019], dated Jan. 1, 2009.

Office Action for Japanese Patent Application No. 2019-505460, dated Mar. 27, 2020, (10 pages), Japanese Patent Office, Tokyo, Japan.

United States Patent and Trademark Office, Office Action for U.S. Appl. No. 15/226,763, dated Apr. 30, 2018, 11 pages, US.

* cited by examiner (a)

(b)

(a)

(b)

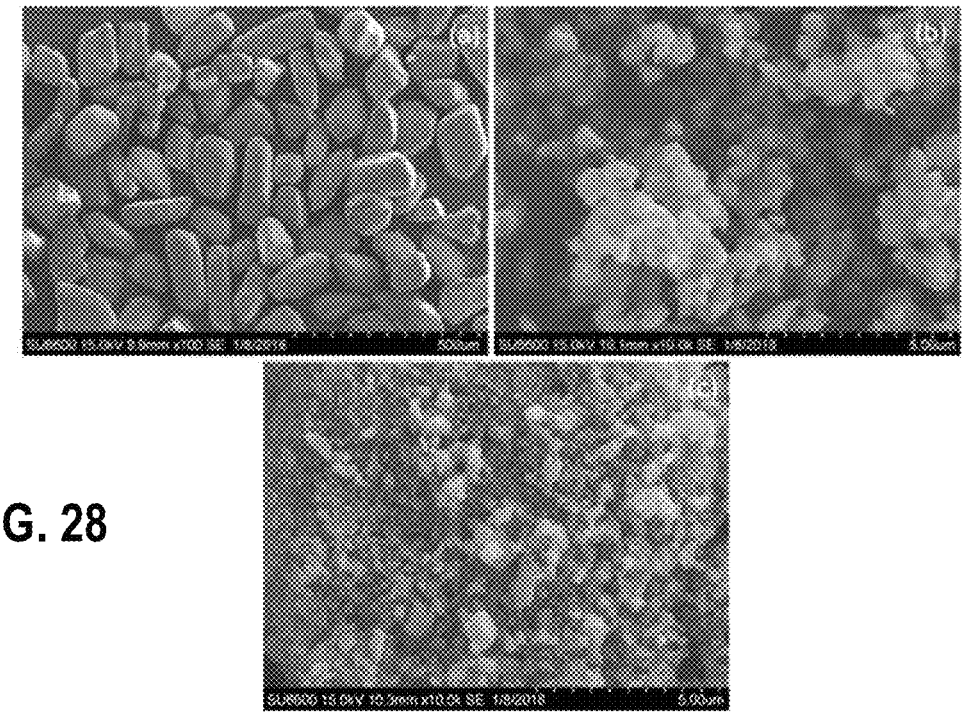
FIG. 28
FIG. 29
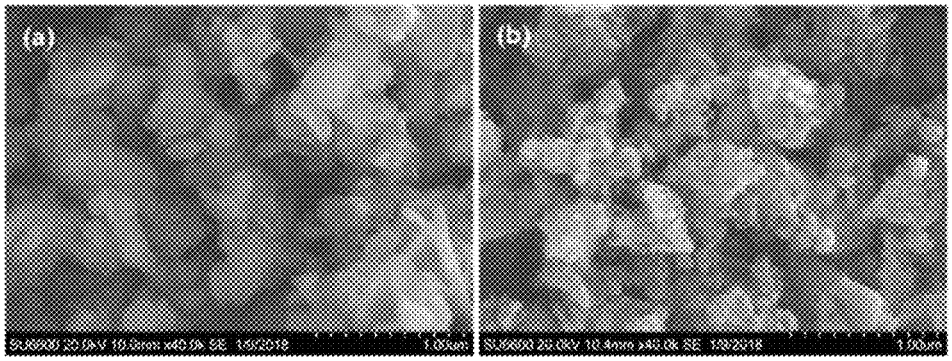

METHOD OF PRODUCING TITANIUM FROM TITANIUM OXIDES THROUGH MAGNESIUM VAPOUR REDUCTION

CROSS-REFERENCE TO RELATED APPLICATIONS

This application is a continuation-in-part of U.S. application Ser. No. 15/226,763, filed Aug. 2, 2016 and now issued as U.S. Pat. No. 10,316,391, issued Jun. 11, 2019, the content of which is incorporated herein in its entirety.

FIELD

This invention relates to the chemical synthesis of titanium metal. Specifically, as compared to prior art methods, the invention disclosed herein provides a simple, efficient, cost-effective method of producing high quality titanium metal while preventing the need for long-duration reaction times or the creation of corrosive intermediates.

BACKGROUND

Titanium is an important metal commonly used in industry due to its desirable properties such as light mass, high strength, corrosion resistance, biocompatibility, and high thermal resistivity. Thus, titanium has been identified as a material suitable for a wide variety of chemical, aerospace, and biomedical applications.

Titanium typically exists in nature as $TiO_2$, more specifically as ilmenite (51% $TiO_2$) and rutile (95% $TiO_2$). Ilmenite and rutile are examples of a "titanium oxide source" material. In $TiO_2$ the oxygen is dissolved into a Ti lattice to form an interstitial solid solution. It is difficult to remove oxygen in a Ti lattice since the thermodynamic stability of the interstitial oxygen is extremely high. Historically, the production of Ti metals from an ore comprising $TiO_2$ has been achieved thorough a reduction process.

There are several approaches that have been reported to reduce a titanium oxide ore to a Ti metal. One of the oldest methods, which is still being used in industry, is the Kroll process. The Kroll process was invented by Wilhelm Kroll and is described in 1938 in U.S. Pat. No. 2,205,854 titled Method for Manufacturing Titanium and Alloys Thereof. In the Kroll Process titanium oxide comprising ores such as refined rutile or ilmenite are reduced at 1000° C. with petroleum-derived coke in a fluidized bed reactor. Next, chlorination of the mixture is carried out by introducing chlorine gas, producing titanium tetrachloride ($TiCl_4$) and other volatile chlorides. This highly volatile, corrosive intermediate product is purified and separated by continuous fractional distillation. The $TiCl_4$ is reduced by liquid magnesium (15-20% excess) at 800-850° C. for 4 days in a stainless steel retort to ensure complete reduction according to the following formula: $2Mg\ (l)+TiCl_4\ (g)\rightarrow 2MgCl_2\ (l)+Ti\ (s)$ [T=800-850° C.]. The resulting product is a metallic Ti sponge, which can be purified by removing $MgCl_2$ thorough vacuum distillation. This process takes 4 days.

In a similar, and slightly older approach (Hunters process), reduction of the $TiCl_4$ intermediate is carried out using sodium metal. Both the Kroll process and Hunter's process are costly, use high temperatures and corrosive intermediates and require long processing durations of between 4-10 days.

To overcome these drawbacks and to improve the productivity and to reduce the cost, another method, which used electrolysis was developed by Derek John Fray, Thomas William Farthing, and Zheng Chen (herein the "FFC process"). The FFC process was described in 1999 in an application titled "Removal of Oxygen from Metal Oxides and Solid Solutions by Electrolysis in a Fused Salt" published as WO1999064638 A1.

In the FFC process, molten calcium chloride is used as an electrolyte, $TiO_2$ pellets are placed at the cathode and graphite is used as the anode. Elevated temperatures around 900-1000° C. are used to melt the calcium chloride since its melting point is 772° C. A voltage of 2.8-3.2 V is applied, which is lower than the decomposition voltage of $CaCl_2$. When the voltage is applied at the cathode, oxygen in the $TiO_2$ abstracts electrons and is converted into oxygen anions and passes through the $CaCl_2$ electrolyte to the graphite anode forming $CO/CO_2$ gas. In this reduction process Ti (+4) is reduced to Ti (0) (i.e., metallic Ti). The pellet created in this electrolysis is then crushed and washed with HCl and consecutively with distilled water to remove the $CaCl_2$ impurities. The resulting product is Ti metal.

Although, it was once anticipated that the FFC process would largely replace the Kroll process, there remain unresolved issues that limit its practical implementation. Some of the major drawbacks include the required use of a large amount of molten salt, slow reaction rates, the creation of undesirable intermediate products $CaTiO_3$, $Ti_3O_5$, $Ti_2O_3$ and TiO, an impure final product and difficulties in process scalability.

In 2004, a method for creating Ti powder thorough calcium vapor reduction of a $TiO_2$ preform was described in the *Journal of Alloys and Compounds* titled "Titanium powder production by preform reduction process (PRP)". In that method, a calciothermic reduction was performed on a $TiO_2$ preform, which was fabricated by preparing a slurry of $TiO_2$ powder, flux ($CaCl_2$ or CaO), and collodion binder solution. The resulting preform was sintered at 800° C. for 1-2 h to remove binder and water before reduction. This sintered $TiO_2$ preform was suspended over a bed of calcium shots in a sealed stainless steel reaction container. Next, the sealed reaction chamber was heated to 1000° C. where the preform was reacted with calcium vapor for 6-10 h. After cooling, the preform was dissolved in acetic acid to remove the flux and excess reductant. The resulting Ti metal was purified by rinsing with HCl, distilled water, alcohol, and acetone and then dried in vacuum. This process has several notable drawbacks including a necessarily long reaction time of 6-10 h and the undesirable formation of impurities such as $CaTiO_3$, $Ti_3O_5$, $Ti_2O_3$ and TiO.

Magnesium vapor has been used to reduce certain metals. For example, U.S. Pat. No. 6,171,363 (the "'363 patent") describes a method for producing tantalum and niobium metal powders by the reduction of their oxides with gaseous magnesium. In the process of the 363 patent, with respect to the production of Ti powder, tantalum pentoxide was placed on a porous tantalum plate which was suspended above magnesium metal chips. The reaction was maintained in a sealed container at 1000° C. for at least 6 h while continuously purging argon. Once the product was brought to room temperature passivation of the product was done by introducing argon/oxygen mixtures, containing 2, 4, 8 and 15 inches (Hg, partial pressure) of $O_2$ (g), respectively, into the furnace. Each gas mixture was in contact with powder for 30 min. The hold time for the last passivation with air was 60 min. Purification of tantalum powder from magnesium oxide was done by leaching with dilute sulfuric acid and next rinsed with high purity water to remove acid residues. The product was a free flowing tantalum, black powder.

In 2013, a process was presented in a *Journal of the American Chemical Society* article titled "A New, Energy-Efficient Chemical Pathway for Extracting Ti Metal from Ti Minerals" that described using magnesium hydride ($MgH_2$) to produce Ti from Ti-slag. In that method Ti-slag was used which contained 79.8% total $TiO_2$ (15.8% $Ti_2O_3$ reported as $TiO_2$), 9.1% FeO, 5.6% MgO, 2.7% $SiO_2$, 2.2% $Al_2O_3$, 0.6% total other metal oxides. The Ti-slag was ball milled for 2 h with a eutectic mixture of 50% NaCl and $MgCl_2$. Prior to adding the eutectic mixture, it was melted, cooled and crushed. Next, $MgH_2$ was mixed into the mixture for an hour in a laboratory tumbler. This mixture was heated in a tube furnace at 500° C. for 12-48 h in a crucible while purging hydrogen at 1 atm. The reduced product was leached in $NH_4Cl$ (0.1 M)/$NaC_6H_7O_7$ (0.77 M) solution at 70° C. for 6 h, this washing step is done to remove the produced MgO. Next, the product was rinsed with water and ethanol and then with NaOH (2 M) solution at 70° C. for 2 h, to remove any silicates. Next it was rinsed again and was leached with HCl (0.6 M) at 70° C. for 4 h, to remove the remaining metal oxides such as Fe. The produced $TiH_2$ was rinsed again and was dried in a rotary drying kiln. The $TiH_2$ powder was dehydrogenated at 400° C. in an argon atmosphere to produce Ti metal.

Each of the above-described methods presents one or more undesirable drawbacks, including but not limited to, the creation of undesirable impurities, the use of high temperatures, long reaction times, scaling constraints, and the formation of corrosive, dangerous intermediaries.

SUMMARY

Disclosed herein is a novel approach to the chemical synthesis of Ti metal from a $TiO_2$ source such as natural and synthetic rutile, ilmenite, anatase, and any oxide or sub oxide or mixed oxide of Ti. The method disclosed herein is more scalable, cheaper, faster and safer than prior art methods. In the approach described herein, a $TiO_2$ source is reacted with Mg vapor to extract a pure Ti metal.

In an embodiment of the inventive process, a composition comprising a $TiO_2$ source is loaded into a reaction chamber along with an excess of a composition comprising an Mg source, such as Mg powder, Mg granules, Mg nanoparticles, or Mg/Ca eutectics. It is preferable that reduction of composition comprising a $TiO_2$ source proceeds without direct physical contact between the composition comprising a $TiO_2$ source and the composition comprising an Mg source in order to reduce the potential for contamination of the resulting Ti product. The reaction chamber is then sealed with a lid, saturated with a noble gas, and heated to an internal temperature of ~80°-1000° C. As long as the temperature is sufficient to vaporize Mg, the reaction will occur. The reaction is carried out for at least ~30 min, and preferably between ~30-120 min. Then, the reaction chamber is cooled to room temperature, and the resulting product is washed with one or more washing media including but not limited to dilute acids (such as HCl, $HNO_3$ and $H_2SO_4$) and water. In other embodiments, $Mg^{2+}$ impurities can be removed by ultra sound assisted water or dilute acid washing. The resulting product is then dried.

In other embodiments, the exemplary reaction described above is modified by varying the reaction temperature and time, and reactant molar ratios. For example, a slightly lower or higher temperature or slightly shorter or longer reaction times can be used and fall within the scope of the inventive process described herein.

In comparison to other Ti producing methods such as the Kroll process, the FFC process, the above-described magnesium vapor method is much more efficient since the time needed to reduce the $TiO_2$ source to Ti is low, noncorrosive materials are used, and Ti suboxide intermediates are avoided. The above-described method is viewed as suitable for the mass scale production of highly pure Ti metal.

According to an aspect of the present invention, a method of producing Ti metal from a Ti comprising mineral or ore is provided. In an example embodiment, the method comprises acid leaching the Ti comprising mineral or ore; mixing the acid leached Ti comprising mineral or ore with an aqueous solution of NaOH; heating a mixture of the acid leached Ti comprising mineral or ore and the aqueous solution of NaOH to extract a Ti comprising compound from the mixture using a hydrothermal treatment; providing at least a portion of the Ti comprising compound in a reaction vessel; providing a composition comprising an Mg source in the reaction vessel; heating the reaction vessel to an internal temperature of between 850° C. and 1000° C. until a vapor of Mg is produced for at least 30 min to form a reaction product; and washing the reaction product with one or more washing media to form a washed Ti reaction product.

In an example embodiment, the method further comprises wet nano-grinding the Ti comprising mineral or ore prior to acid leaching the Ti comprising mineral. In an example embodiment, the hydrothermal treatment comprises heating the mixture within a hydrothermal treatment vessel to a temperature between 250° C. and 500° C. for at least 2 h to cause formation of a crystalline Ti compound. In an example embodiment, the hydrothermal treatment comprises heating the mixture within a hydrothermal treatment vessel to a temperature of approximately 300° C. for approximately 4 h. In an example embodiment, the composition comprising Mg comprises Mg powder. In an embodiment, the Mg powder comprises Mg nanopowder. In an example embodiment, the washed Ti reaction product has a purity of greater than 99% Ti. In an example embodiment, the reaction vessel is heated to an internal temperature of between 850° C. and 1000° C. for about 2 h to form a reaction product. In an example embodiment, the reaction vessel is heated to an internal temperature of about 900° C. for about 2 h to form a reaction product. In an example embodiment, the one or more washing media are selected from the group consisting of HCl, $HNO_3$, $H_2SO_4$, distilled water, and deionized water. In an example embodiment, the method further comprises providing inert gas in the reaction vessel. In an example embodiment, the inert gas is argon. In an example embodiment, the reaction vessel contains a first tray upon which the $TiO_2$ source is placed and a second tray upon which the Mg source is placed. In an example embodiment, one or both of the first tray and second tray are vibrated while the reaction vessel is heated. In an example embodiment, the reaction vessel further comprises a rotating drum and wherein the $TiO_2$ source is placed in the rotating drum and wherein the Mg source comprises Mg vapor and wherein the Mg vapor is purged into the rotating drum. In an example embodiment, ultrasound sonication was used during at least a portion of the washing of the reaction product with the one or more washing media. In an example embodiment, the ultrasound sonication was used for approximately 2-5 min during the washing of the reaction product with the one or more washing media. In an example embodiment, the mixture is contained within a hydrothermal treatment vessel during the hydrothermal treatment. In an example embodiment, the hydrothermal treatment vessel is a Teflon tube.

According to another aspect of the present invention, a method of producing Ti metal from rutile is provided. In an example embodiment, the method comprises acid leaching of the rutile to form an iron-leached out Ti comprising mineral; providing the iron-leached out Ti comprising mineral and a basic aqueous solution inside a hydrothermal treatment vessel; heating the hydrothermal treatment vessel to a temperature between 200° C. and 500° C. for at least 2 h to form a suspension comprising Ti; washing the suspension comprising Ti with one or more first washing media to produce a composition comprising Ti; providing the composition comprising Ti in a reaction vessel; providing a composition comprising Mg in the reaction vessel; heating the reaction vessel to an internal temperature of between 850° C. and 1000° C. until a vapor of Mg is produced for at least 30 min to form a reaction product; and washing the reaction product with one or more second washing media.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 28 shows scanning electron microscopy images of (a) natural rutile, (b) synthetic rutile and (c) ground and acid leached natural rutile, according to an example embodiment;

FIG. 29 shows scanning electron microscopy images of Ti sponge (a) before leaching with acid and (b) after leaching with acid, according to an example embodiment;

DETAILED DESCRIPTION

The following description provides detailed embodiments of various implementations of the invention described herein. After reading this description, it will become apparent to one skilled in the art how to implement the invention in various alternative embodiments and alternative applications. However, although various embodiments of the present invention will be described herein, it is understood that these embodiments are presented by way of example only, and not limitation. As such, the detailed description of various alternative embodiments should not be construed to limit the scope or the breadth of the invention. As used herein, the term approximately refers to values that are within manufacturing and/or engineering standards and/or tolerances.

An Example Process of Reducing $TiO_2$

Figure 1:
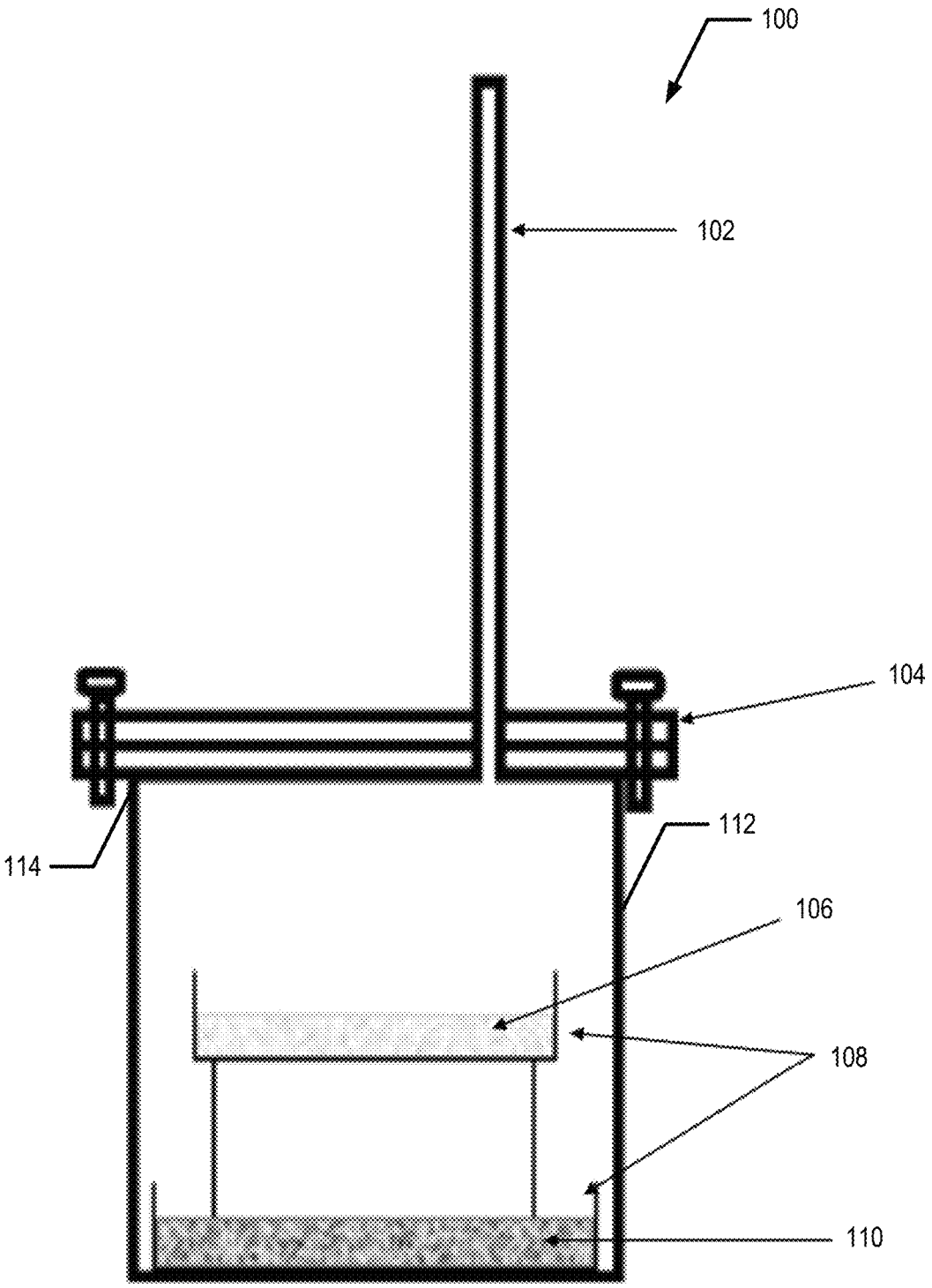
FIG. 1 is a schematic illustration of the experimental set-up used for $TiO_2$ reduction process, according to an example embodiment.
Figure 2:
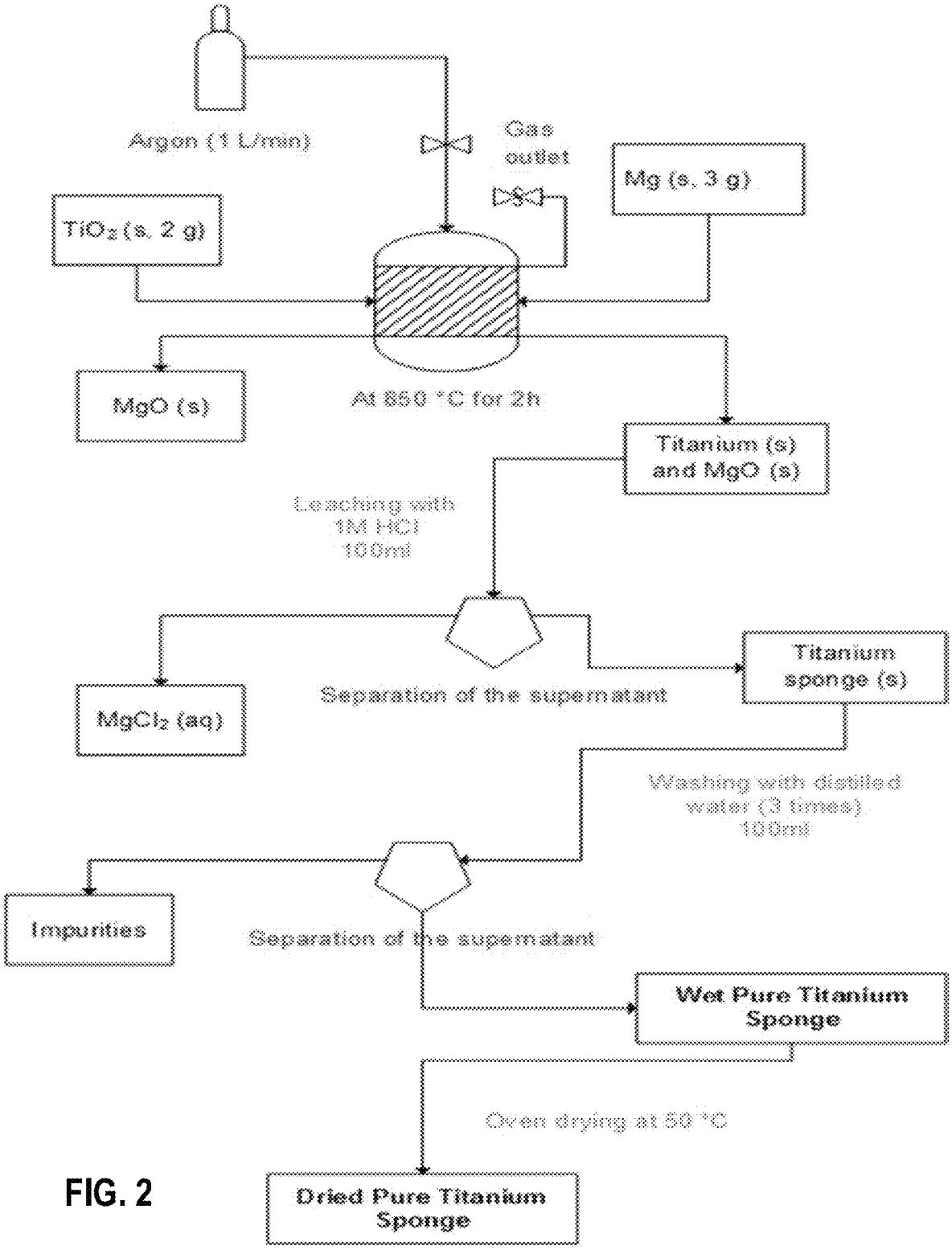
FIG. 2 is a process flow diagram of the Ti extraction process, according to an example embodiment.
Figure 2A:
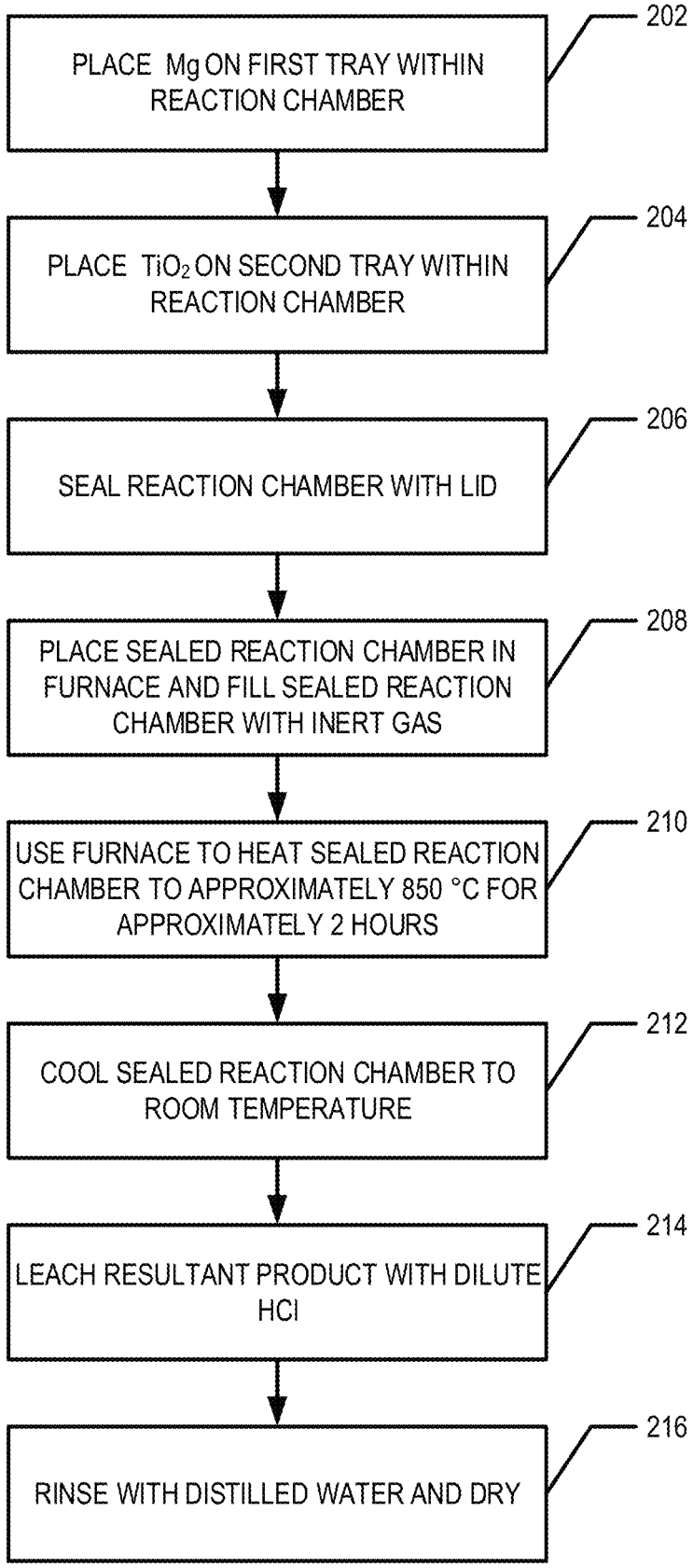
FIG. 2A provides a flowchart illustrating processes and procedures of an example embodiment of the Ti extraction process.

With reference to FIGS. 1, 2, and 2A in an example embodiment, a bed of approximately 2.00 g of >99% Mg powder 110 is loaded on a first non-corrosive (e.g., stainless steel) tray 108 and placed in a reaction chamber 112 of reaction vessel 100 (at block 202). A bed of 2.00 g of ≥99% pure $TiO_2$ powder 106 (e.g., obtained from Sigma Aldrich) is loaded onto a separate second non-corrosive (e.g., stainless steel ("SS")) tray 108 which is suspended over the bed of Mg powder 110 (at block 204). (See, e.g., FIG. 1). In an example embodiment, Mg is used in excess. These non-corrosive trays 108 are placed in a non-corrosive reaction chamber 112 of reaction vessel 100. In an example embodiment, the non-corrosive reaction chamber 112 is then sealed with a lid 104 (at block 206). In an example embodiment, the rim of the sealed container is covered by a ceramic paste 114 to further seal the chamber 112. In an example embodiment, the reaction chamber and/or the lid is made, at least in part, of stainless steel.

In various embodiments, the sealed reaction chamber 112 with the first and second non-corrosive trays 108 sealed therein is placed in a furnace. In an example embodiment, the sealed chamber 112 is filled with an inert gas (e.g., as shown in FIG. 1), such as, for example, argon. The inert gas is provided to the interior of the sealed chamber 112 via the inert gas inlet 102 (at block 208). In an example embodiment, the inert gas is continuously purged (e.g., inert gas is continuously provided via the inert gas inlet 102 and removed via the inert gas outlet (not shown)). In an example embodiment, the inert gas is provided into the sealed reaction chamber 112 prior to heating of the reaction chamber 112 and removed after the heating of the reaction chamber 112. In an example embodiment, the inert gas may be purged from the interior of the sealed reaction chamber 112 and the reaction chamber 112 may be refilled a predetermined and/or configurable number of times during the heating of the reaction chamber 112. The sealed reaction chamber 112, is then heated to approximately 850° C. (at block 210). The reaction is carried out for approximately 2 h, during which time the vapor pressure of Mg is approximately $4.64\times10^3$ Pa.

Afterwards, the reaction chamber 112 is cooled to room temperature (e.g., approximately 18-30° C.) (at block 212). In an example embodiment, the reaction chamber 112 is actively cooled and in another embodiment, the reaction chamber 112 is passively cooled. The resulting product is leached overnight and/or for approximately 8-12 h with dilute HCl acid (1 M, 100 mL) to remove the MgO (at block 214). Next, the product is rinsed with distilled water to remove the acid residues and dried at approximately 50° C. (at block 216). An embodiment of this process flow is summarized in FIG. 2.

In some embodiments, the reaction process described above is repeated at different temperatures, $TiO_2$:Mg reactant molar ratios, and reaction times. In an embodiment, the reaction vessel comprises a rotating drum into which Mg vapor is purged.

In some embodiments, ultrasound sonication is used to aid the washing and/or rinsing process in order to improve the removal of MgO from the product. For example, in some embodiments ultrasound sonication was used for approximately 2-5 min to aid in the washing and/or drying process. In an example embodiment, the first and/or second tray 108 is vibrated using, for example, ultrasound sonication and/or mechanical vibration means, during at least a portion of the washing and/or drying process.

Characterization of Titanium Sponge

The effects of reaction parameters such as temperature, reaction time, and reactant molar ratios on the nature and purity of the final product were investigated as described herein with reference to various figures.

Figure 3:
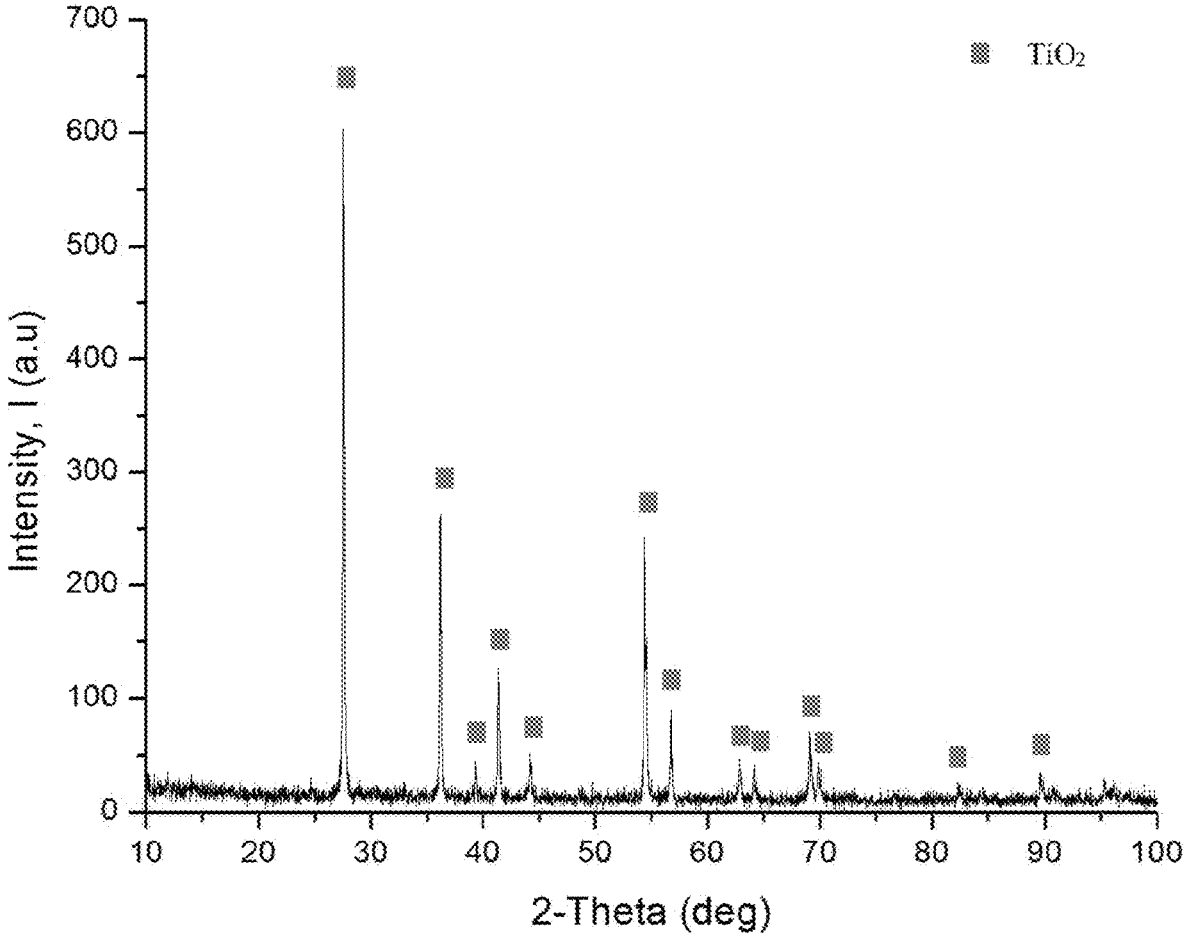
FIG. 3 is a powder X-ray diffraction pattern of $TiO_2$.
Figure 4:
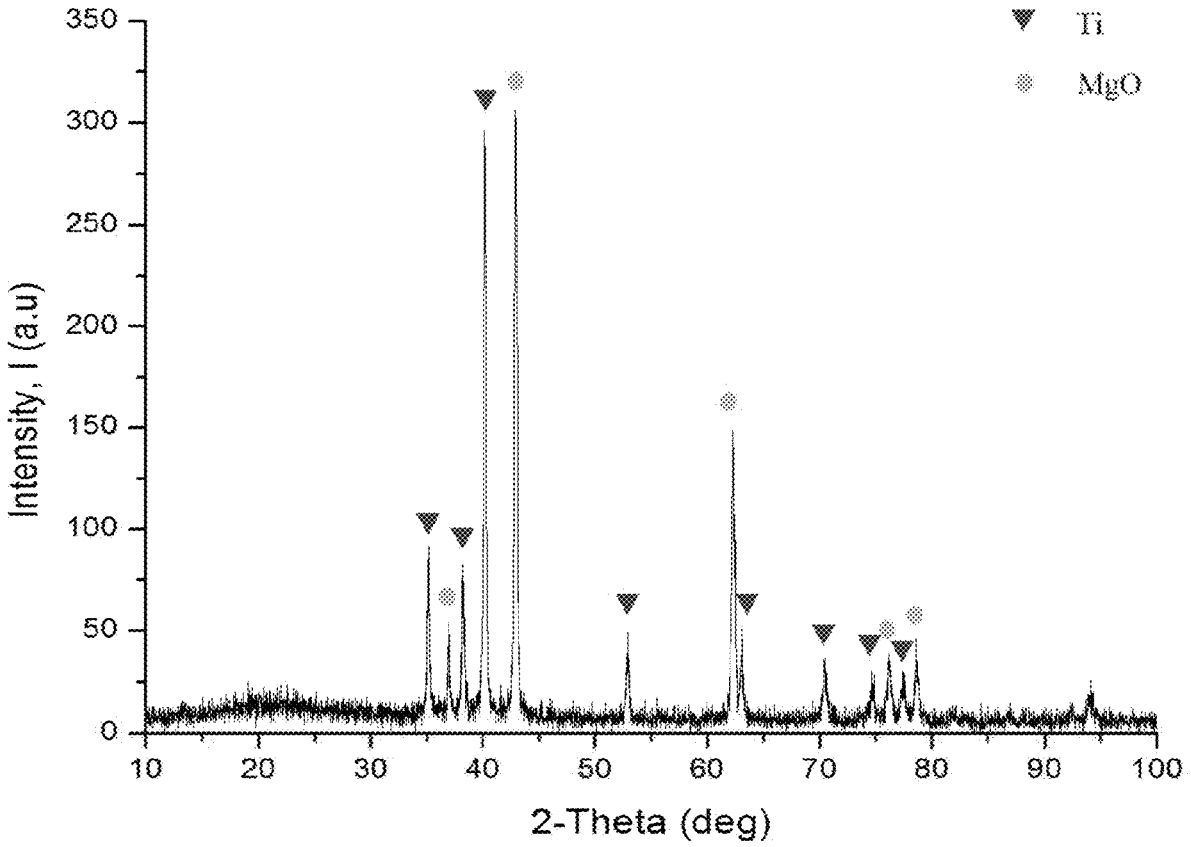
FIG. 4 is a powder X-ray diffraction patterns of the products obtained after the reduction of $TiO_2$ with Mg prior to leaching with dilute HCl acid, according to an example embodiment.
Figure 5:
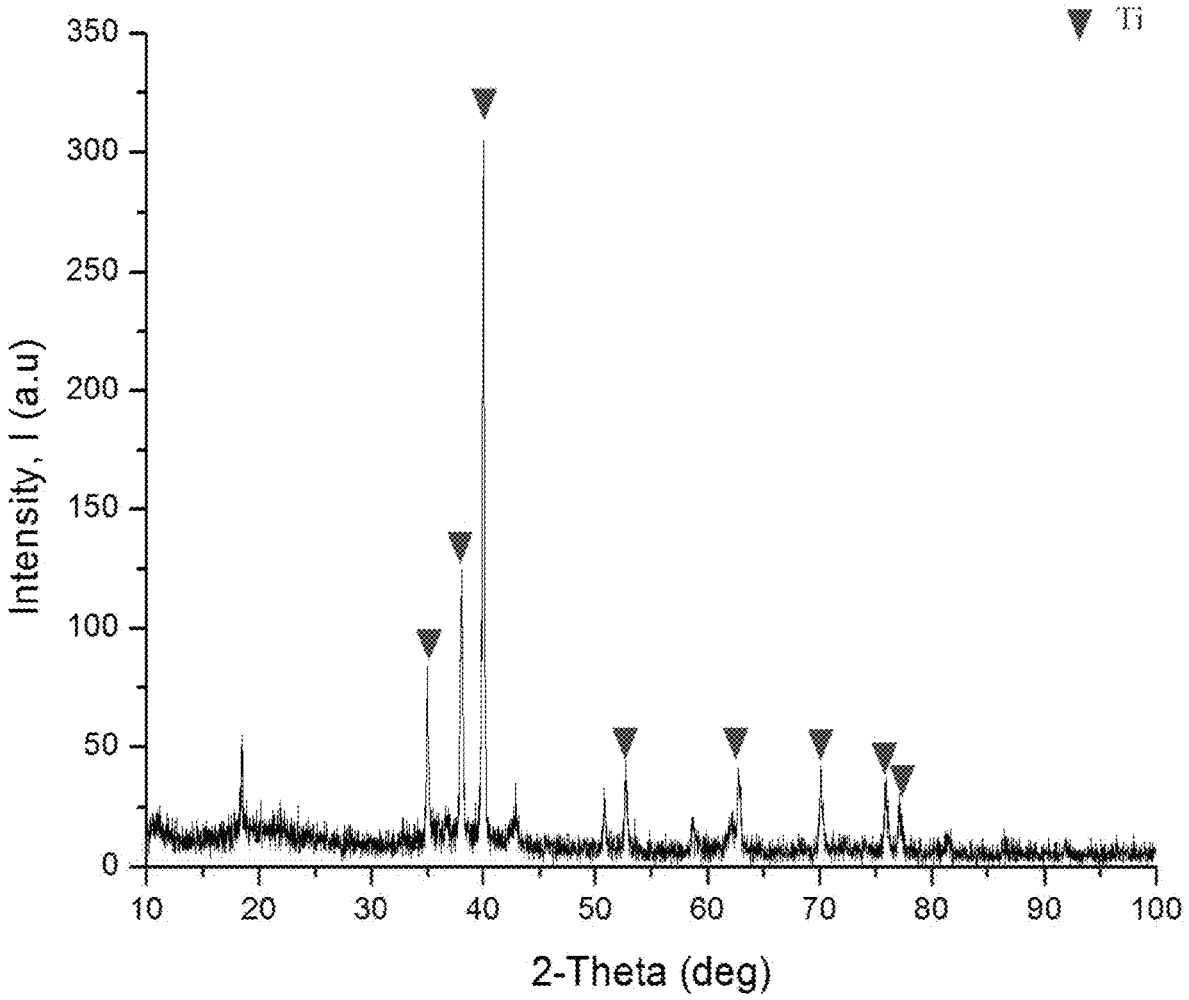
FIG. 5 is a powder X-ray diffraction pattern of the product obtained after the reduction of $TiO_2$ with Mg followed by leaching with dilute HCl acid, according to an example embodiment.

FIG. 3 is the powder X-ray diffraction (PXRD) pattern for pure $TiO_2$. The PXRD patterns of the product obtained when $TiO_2$ is reduced with Mg (850° C., 2 h, argon environment but before leaching with dilute HCl acid clearly showed peaks related to Ti and as well as MgO, as shown in FIG. 4. Only Ti peaks were observed after the product was leached with dilute HCl, as shown in FIG. 5, indicating that the MgO had been completely removed. Furthermore, there were no residual $TiO_2$ peaks observed and there was no formation of any other titanium sub-oxides.

Table 1 (a) is the elemental analysis data based on energy dispersive X-ray spectroscopy (EDX data) of the product before leaching in dilute HCl acid. The EDX data before leaching confirms that there is a high percentage of MgO with a 35.12 wt % of Mg and 28.16 wt % of O and a low percentage of Ti of 36.72 wt %.

TABLE 1(a)

EDX data after the reaction of $TiO_2$ with Mg (prior to leaching in HCl acid)

| Element Line | Net Counts | Net Counts Error | Weight % | Weight % Error | Atom % |
|---|---|---|---|---|---|
| O | 23879 | +/−625 | 28.16 | +/−0.36 | 33.33 |
| Mg | 117867 | +/−1098 | 35.12 | +/−0.16 | 36.42 |
| Ti | 33747 | +/−539 | 36.72 | +/−0.29 | 19.51 |
| Total | | | 100.00 | | 100.00 |

The EDX data of the product after leaching shown in table 1 (b) indicates Ti with a high percentage of 99.37 wt % and a low oxygen percentage of 0.63 wt %. The oxygen detected may be due to the formation of an oxide layer over the Ti metal.

TABLE 1(b)

EDX data after the reaction of $TiO_2$ with Mg (after leaching in acid)

| Element Line | Net Counts | Net Counts Error | Weight % | Weight % Error | Atom % |
|---|---|---|---|---|---|
| O | 397 | +/−126 | 0.63 | +/−0.09 | 1.83 |
| Ti | 350246 | +/−1903 | 99.37 | +/−0.27 | 98.17 |
| Total | | | 100.00 | | 100.00 |

Figure 6:
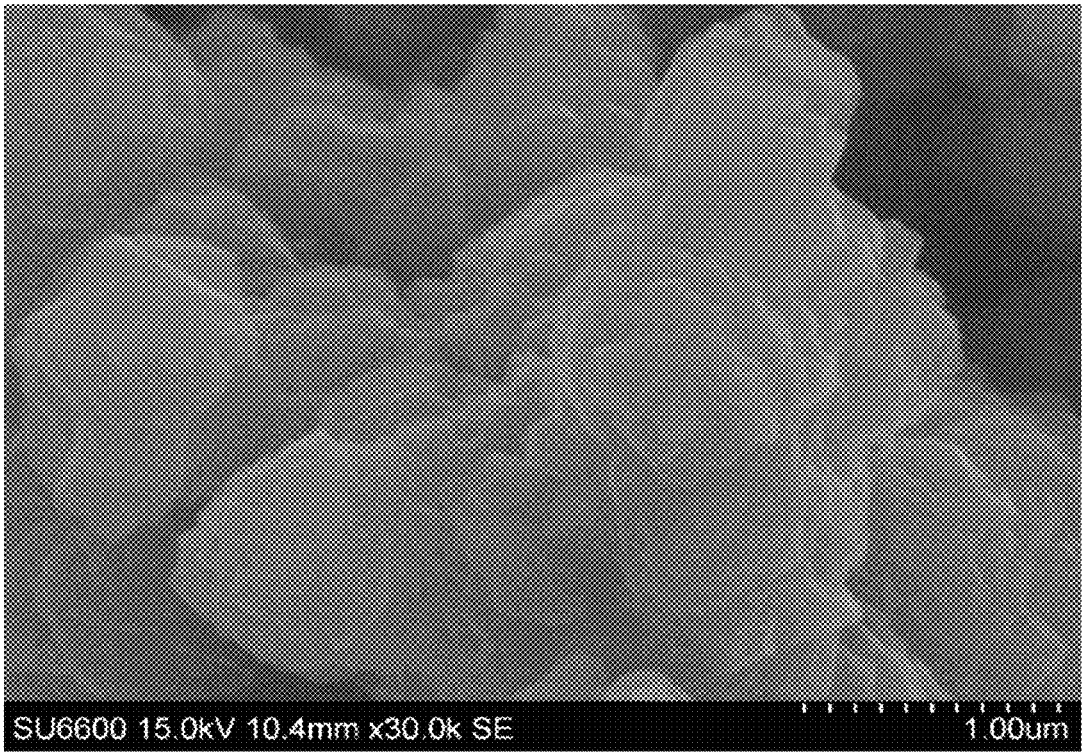
FIG. 6 shows scanning electron microscopy images of the products obtained when $TiO_2$ is reacted with Mg vapor (a) before leaching and (b) after leaching with dilute HCl acid, according to an example embodiment.
Figure 6:
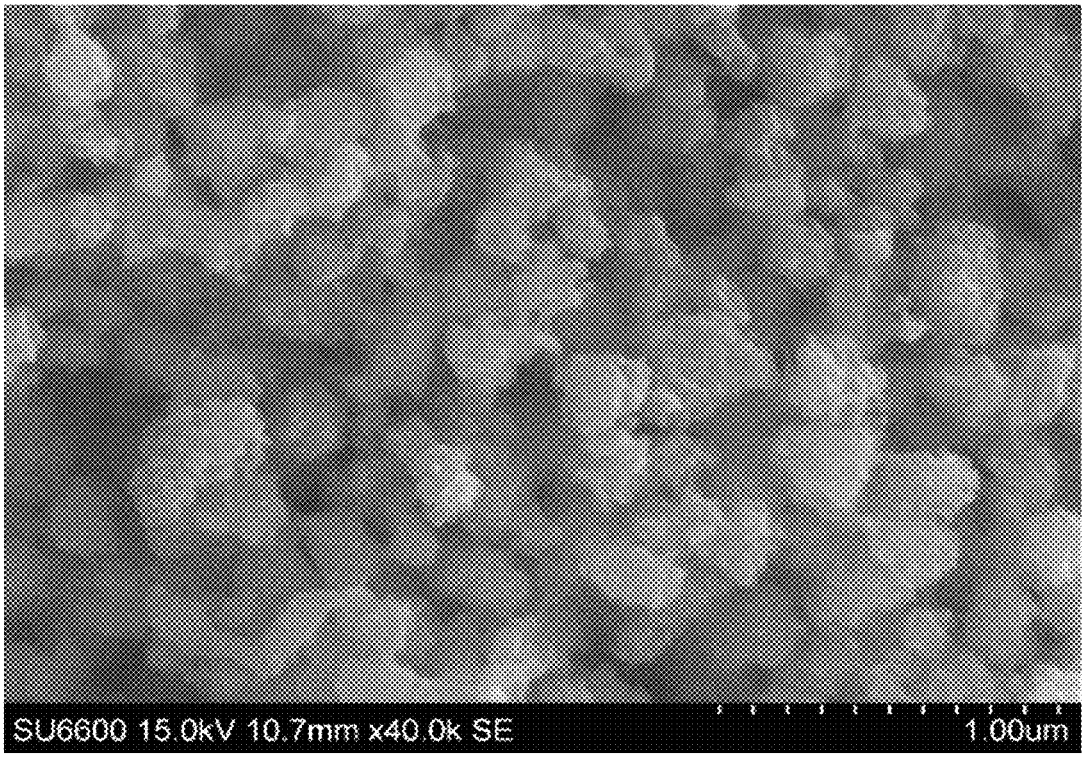

FIG. 6 at (a) shows a scanning electron microscopy (SEM) image of the product before leaching with dilute HCl acid. The morphology of the product before leaching shows a plate like formation which is mainly due to the presence of crystalline MgO. FIG. 6 at (b) shows an SEM image of the product after leaching in HCl acid and washing and/or rinsing with distilled water. In this image Ti particles are observed, and the particle size of the product has been reduced after leaching when compared with the image taken before leaching. This indicates that MgO was produced as a layer over the produced Ti particles, and that layer has been washed away thorough the acid leaching and/or washing and/or rinsing with distilled water step(s).

Figure 7:
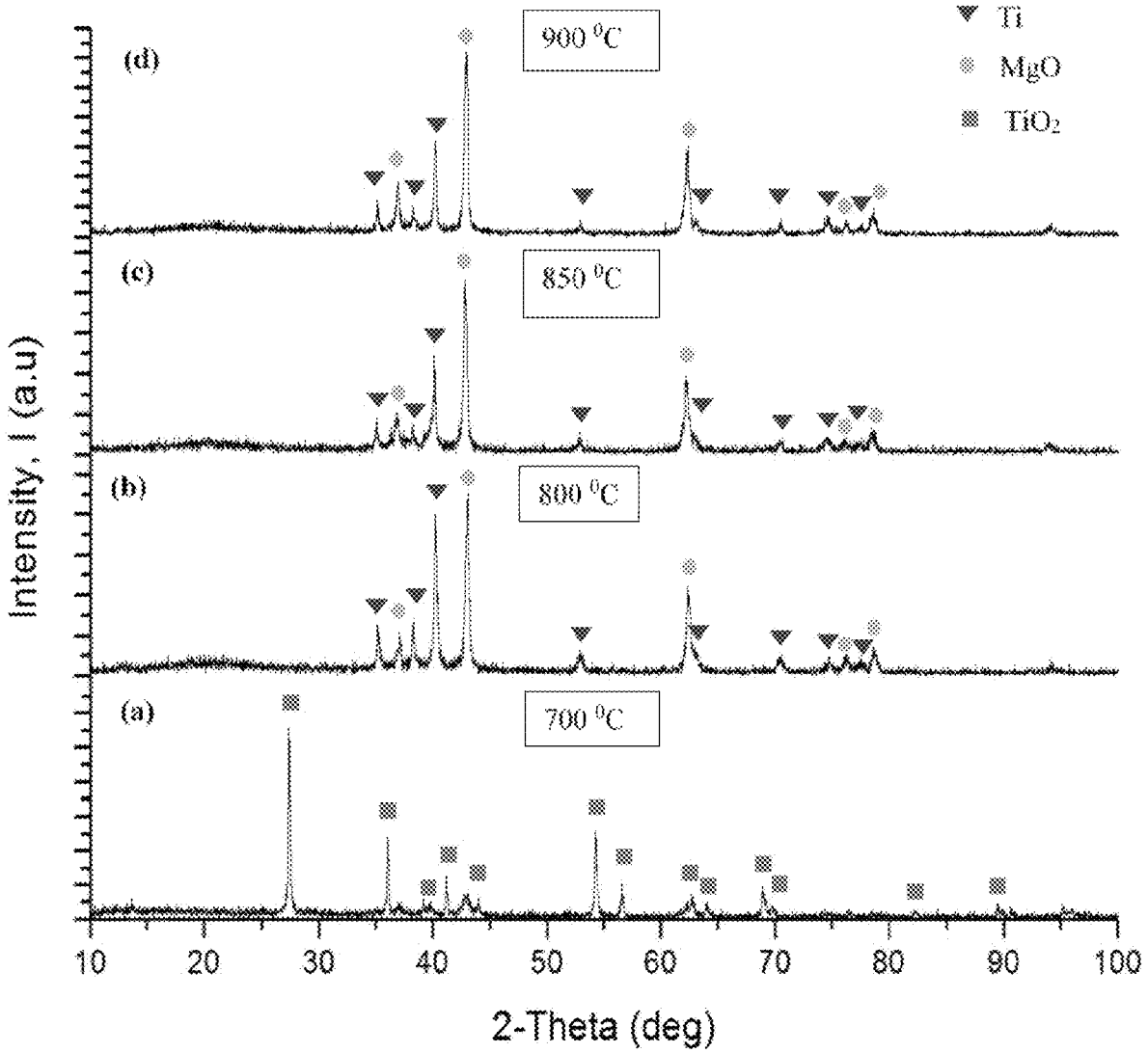
FIG. 7 shows powder X-ray diffraction patterns of the products obtained when the $TiO_2$ reduction process is performed at the following temperatures: (a) 700° C. (b) 800° C. (c) 850° C. and (d) 900° C. before leaching with dilute HCl acid, according to example embodiments.
Figure 8:
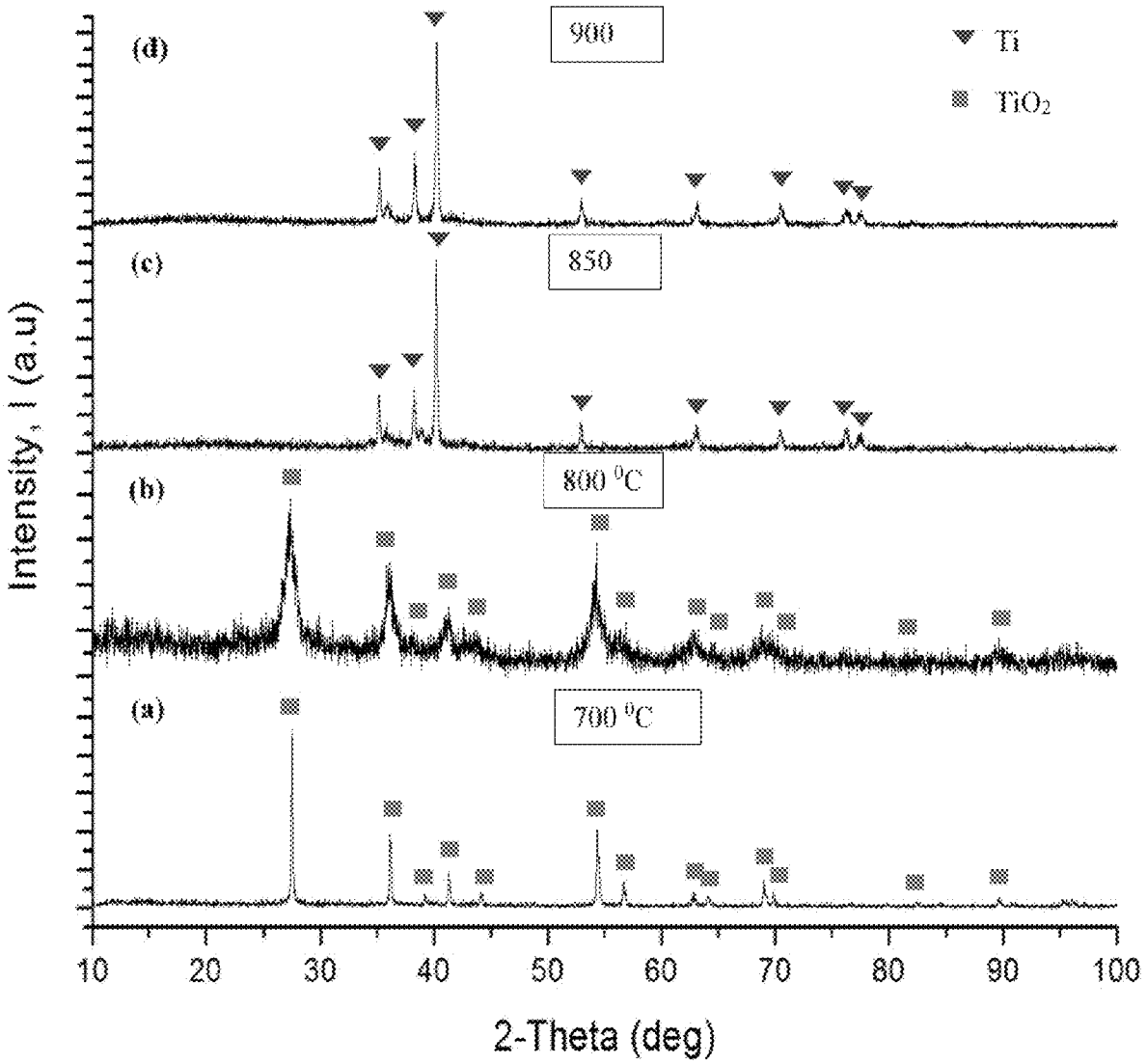
FIG. 8 shows powder X-ray diffraction patterns of the products obtained when the $TiO_2$ reduction process is performed at the following temperatures: (a) 700° C. (b) 800° C. (c) 850° C. and (d) 900° C. after leaching with dilute HCl acid, according to example embodiments.

FIG. 7 shows the PXRD patterns obtained for the products received by varying the temperature of the Mg reduction process from 700° C., 800° C., 850° C., and 900° C. FIG. 8 shows the PXRD patterns after removing Mg impurities by washing with dilute HCl acid and washing and/or rinsing with distilled water. As observed by the PXRD patterns the reactions carried out at 700° C. and 800° C. have led to an incomplete conversion into Ti metal. As shown by the patterns for FIG. 8 there are a significant amount of starting materials left in the sample for the reactions carried out at 700° C. and 800° C. According to the PXRD patterns at all other temperatures (850° C. and 900° C.) a complete reduction of $TiO_2$ into Ti metal has occurred.

Figure 9:
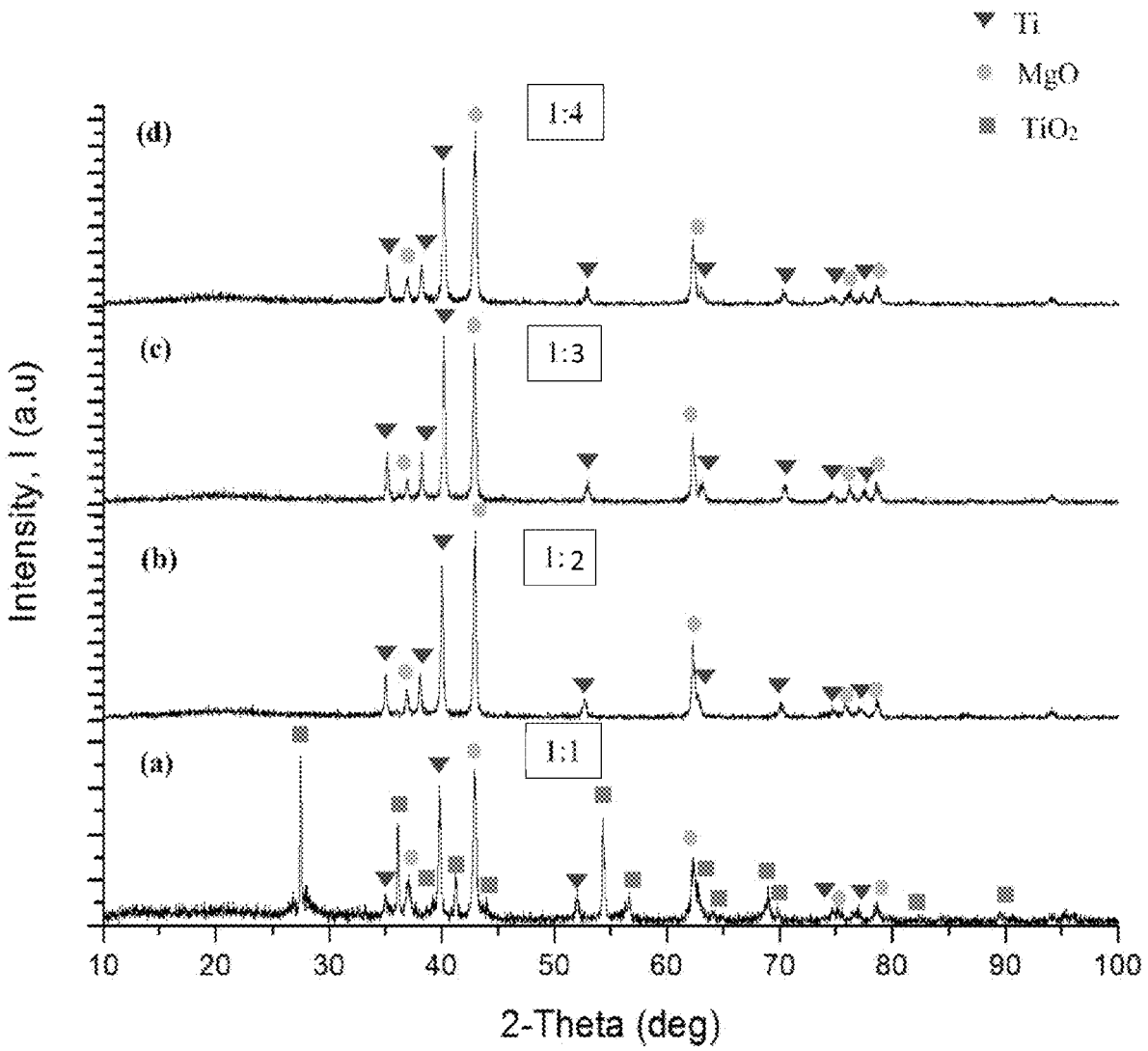
FIG. 9 shows powder X-ray diffraction patterns of the products obtained when the $TiO_2$ reduction process is performed with the following $TiO_2$ to Mg molar ratios: (a) 1:1 (b) 1:2 (c) 1:3 and (d) 1:4, at 850° C. for 2 h before leaching with dilute HCl acid, according to example embodiments.
Figure 10:
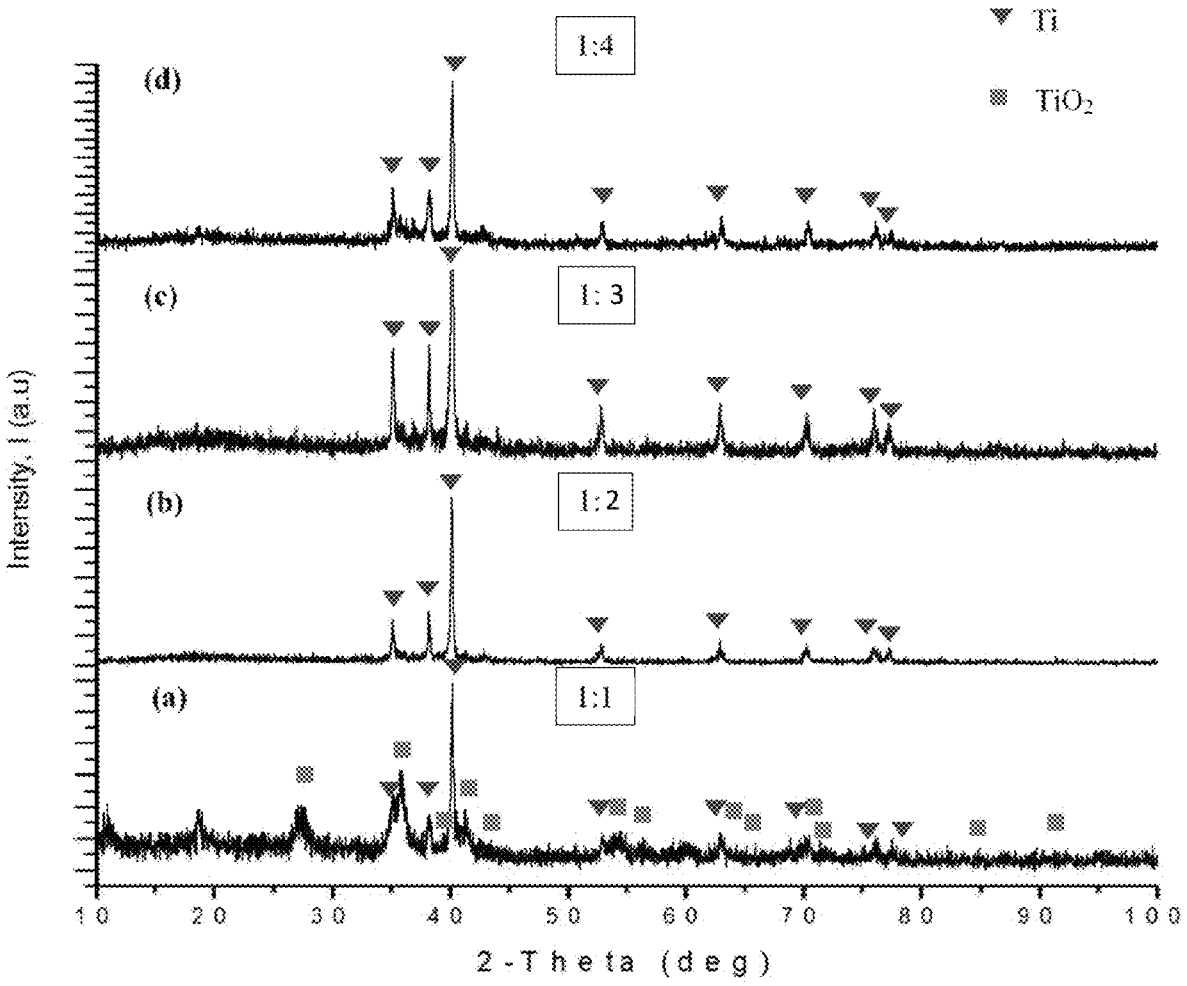
FIG. 10 shows powder X-ray diffraction patterns of the products obtained when the $TiO_2$ reduction process is performed with the following $TiO_2$ to Mg molar ratios: (a) 1:1 (b) 1:2 (c) 1:3 and (d) 1:4, at 850° C. for 2 h after leaching with dilute HCl acid, according to example embodiments.

The amount of Mg required was tested at different molar ratio of reactants ($TiO_2$ to Mg powder) at 850° C., for 2 h. As shown in FIGS. 9 and 10, at the ratio of $TiO_2$ to Mg of 1:1, Ti peaks were observed with another set of peaks which is related to unreacted $TiO_2$. The observations suggest that the optimum molar ratio of $TiO_2$:Mg is 1:2 for complete conversion of $TiO_2$ to Ti. At higher molar ratios a significant amount of tightly bound Mg remained in the product, which was difficult to remove with simple acid washing steps.

Figure 11:
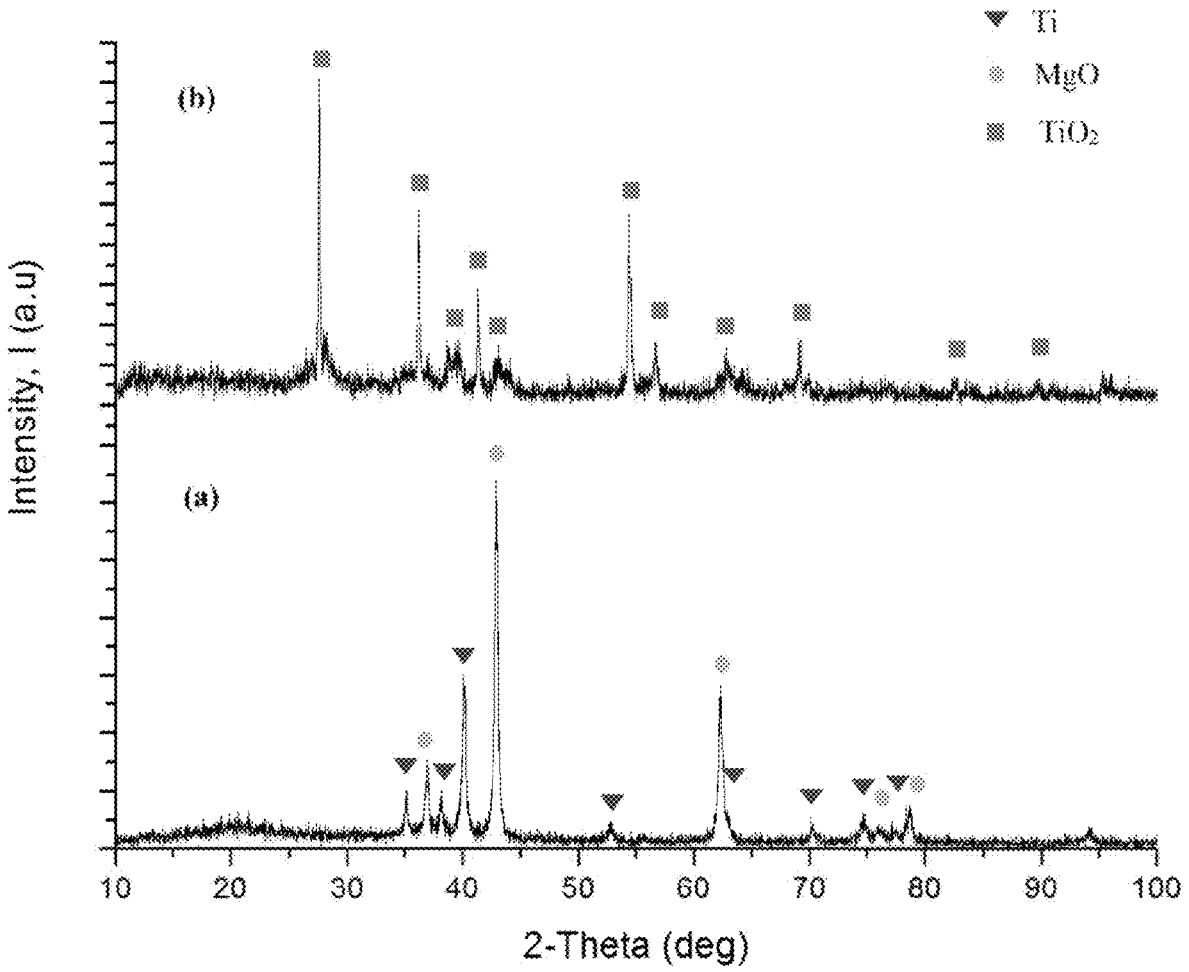
FIG. 11 shows powder X-ray diffraction patterns of the products obtained when the $TiO_2$ reduction process is performed at a reaction time of 0.5 h (a) before leaching (b) after leaching, at 850° C. with 1:2 molar ratio of $TiO_2$ to Mg, according to an example embodiment.
Figure 12:
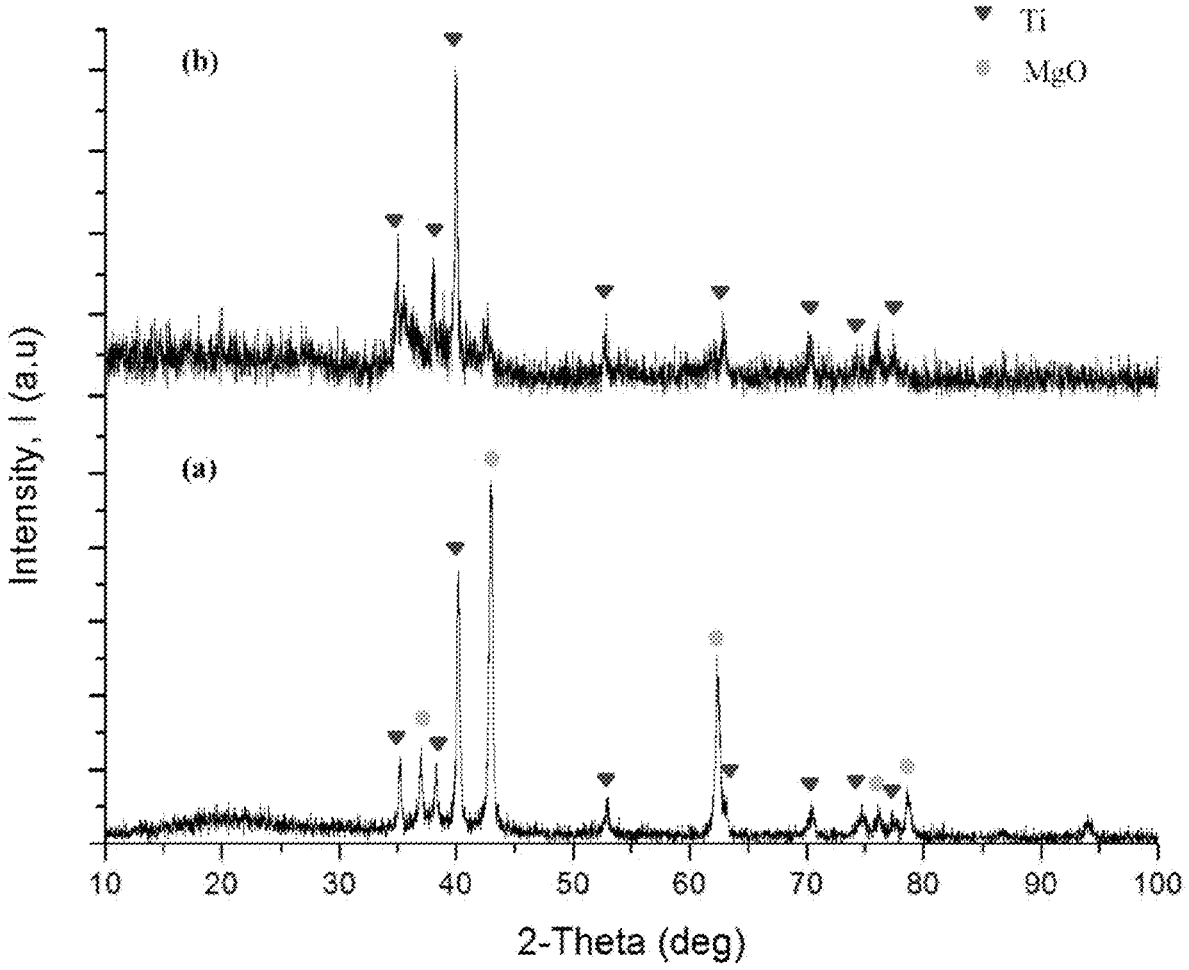
FIG. 12 shows powder X-ray diffraction patterns of the products obtained when the $TiO_2$ reduction process is performed at a reaction time of 1 h (a) before leaching (b) after leaching, at 850° C. with 1:2 molar ratio of $TiO_2$ to Mg, according to an example embodiment.

FIGS. 11 and 12 show the PXRD patterns of products related to reactions carried out for different times at 850° C. with 1:2 molar ratio of reactants ($TiO_2$ to Mg). In the embodiments shown, the reaction carried out for 0.5 h showed some unreacted $TiO_2$ as shown in FIG. 11. However the reaction carried for 1 h lead to formation of Ti metal without the presence of any suboxide peaks of Ti as shown in FIG. 12.

Figure 13:
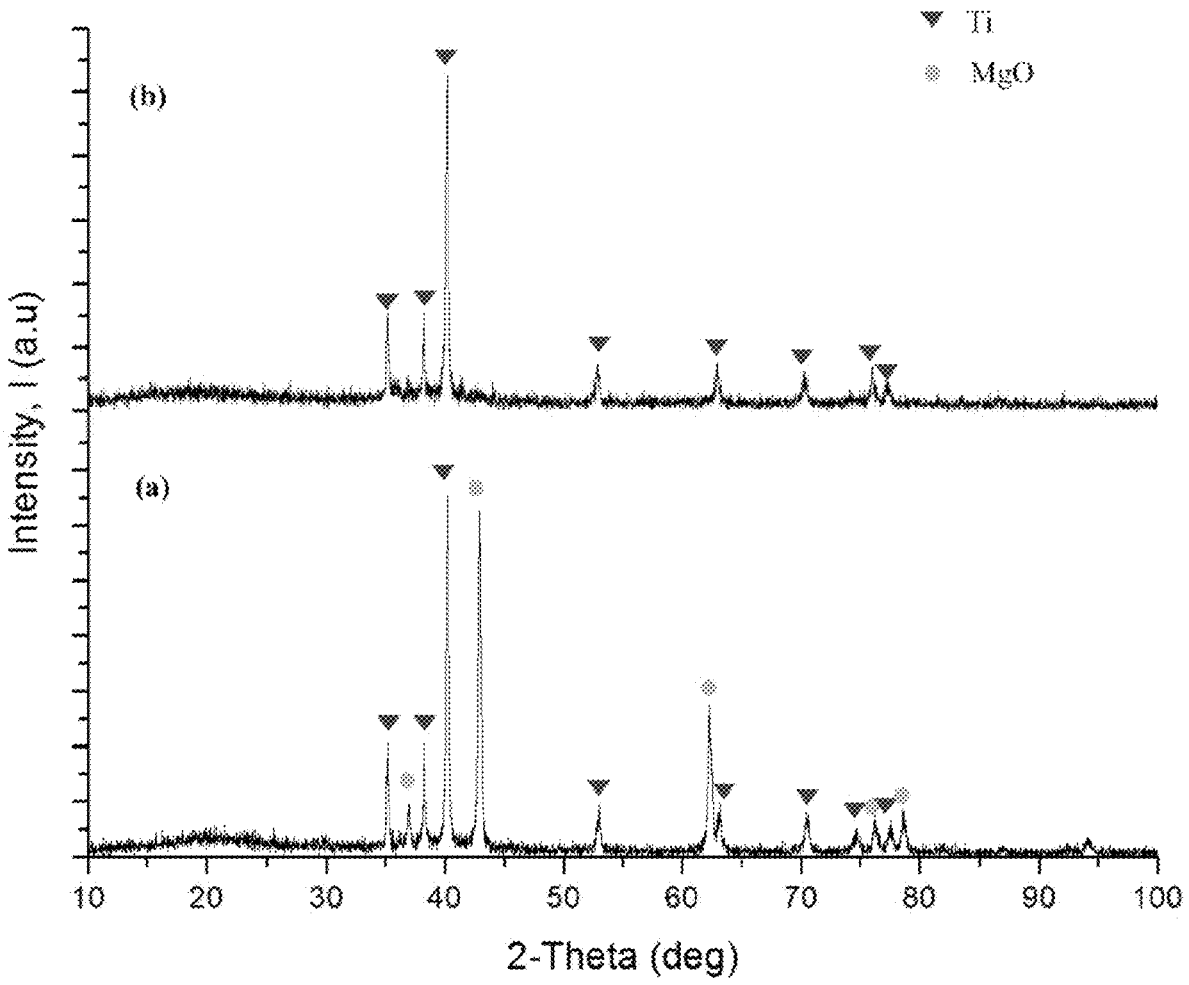
FIG. 13 shows powder X-ray diffraction patterns of $TiO_2$ reduction products obtained by leaching with dilute HCl acid under sonication (a) before leaching (b) after leaching, according to an example embodiment.
Figure 14:
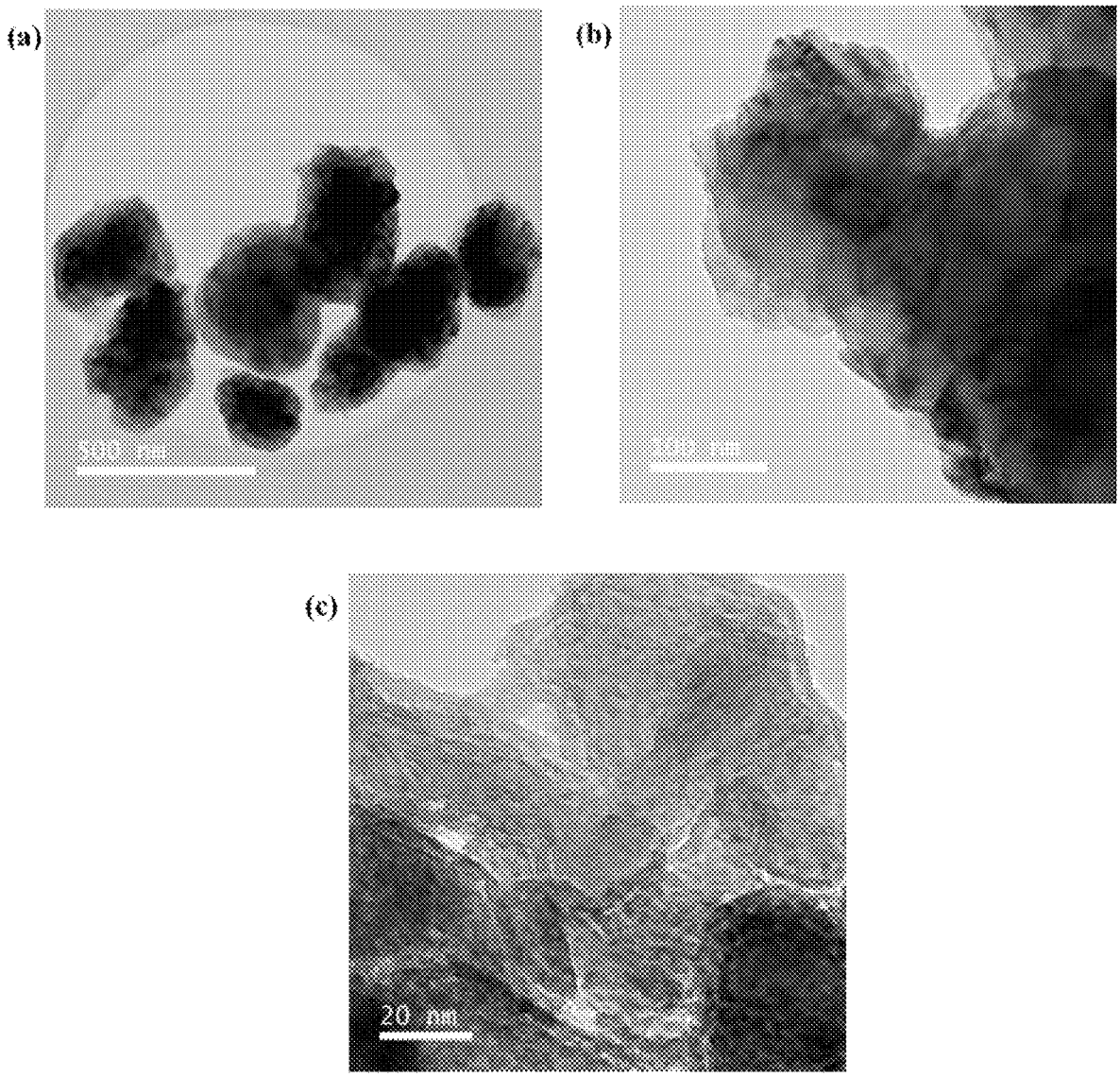
FIG. 14 shows transmission electron microscopy images of $TiO_2$ reacted with Mg vapor (a) before leaching with dilute HCl acid at low resolution, (b) before leaching with dilute HCl acid at high resolution, and (c) after leaching with dilute HCl at high resolution; according to an example embodiment.

In another embodiment, the product obtained by the reduction of $TiO_2$ with Mg (1:2 ratio, 2 h, 850° C.) was washed with a dilute HCl (100 mL) in the presence of ultrasound sonication (at frequency of 80 kHz, 3 min, two times). The PXRD patterns of the resulting product before and after leaching are given in FIG. 13 at (a) and (b) respectively.

Further structural studies obtained on a product from a preferred embodiment process (temperature 850° C., time 2 h, $TiO_2$:Mg molar ratio 1:2, ultrasound assisted dilute HCl washing) were carried out using transmission electron microscopic imaging (TEM), electron energy loss spectroscopy (EELS) and energy dispersive spectroscopy (EDX) spectral analysis and imaging. According to the TEM imaging (FIGS. at 14 (*a*) and (*b*)) the product obtained after reacting $TiO_2$ with Mg vapor results in a co-shell product where the Ti particles are covered with MgO layer where there is a clear image contrast (area related to Ti metal appears darker than those of MgO). This observation suggests that lattice level interactions have occurred when the Mg vapor penetrates into the lattice of the $TiO_2$. When the Ti—MgO product is washed with dilute HCl acid the image contrast no longer appears suggesting the complete removal of MgO.

Figure 15:
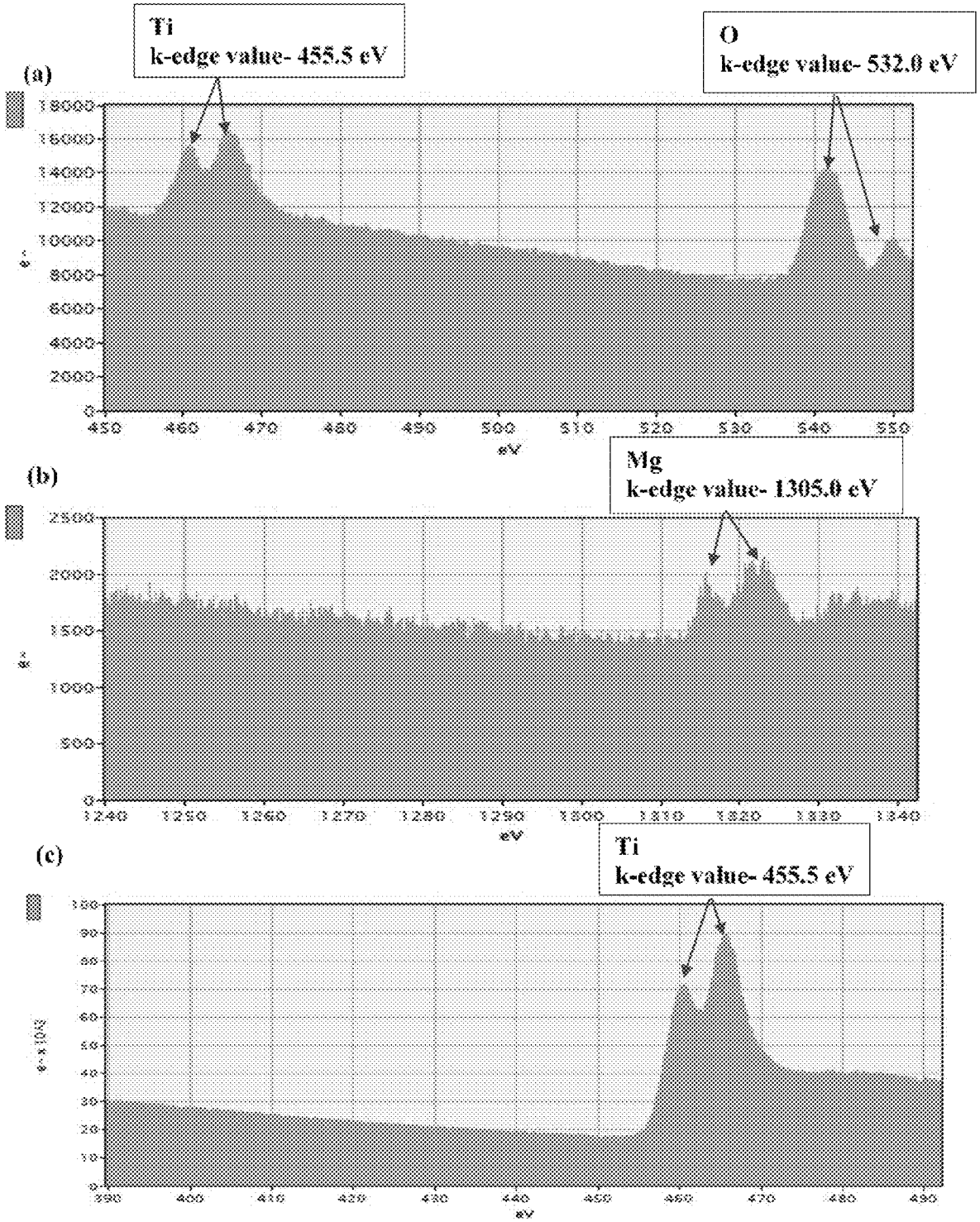
FIG. 15 shows electron energy loss spectroscopy results of $TiO_2$ reacted with Mg vapor (a) before leaching with dilute HCl showing Ti and O edges, (b) before leaching with dilute HCl showing Mg edges, and (c) after leaching with dilute HCl showing only Ti edges, according to an example embodiment.

According to the EELS results, Ti, O, and Mg K-edges at 455.5 eV, 532.0 eV, and 1305.0 eV respectively, are observed in the Ti—MgO co-shell product. (FIG. 15 at (a) and (b)) When the product is leached with dilute HCl acid, both O and Mg K-edges disappear leaving only the Ti K-edges. (FIG. 15 at (c))

Figure 16:
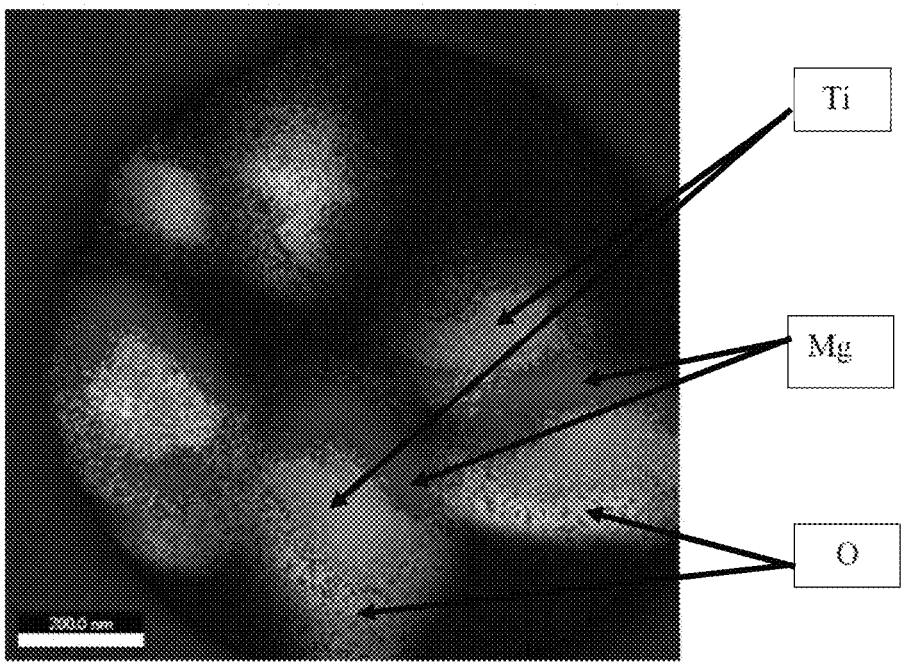
FIG. 16 shows energy dispersive X-ray diffraction results of $TiO_2$ reacted with Mg vapor (a) before leaching with dilute HCl acid showing Ti in the core of the particle and Mg and O as a coating around the Ti core, (b) $TiO_2$ reacted with Mg vapor after leaching with dilute HCl acid showing Ti and an oxidized layer of oxygen around the Ti, according to an example embodiment.
Figure 16:
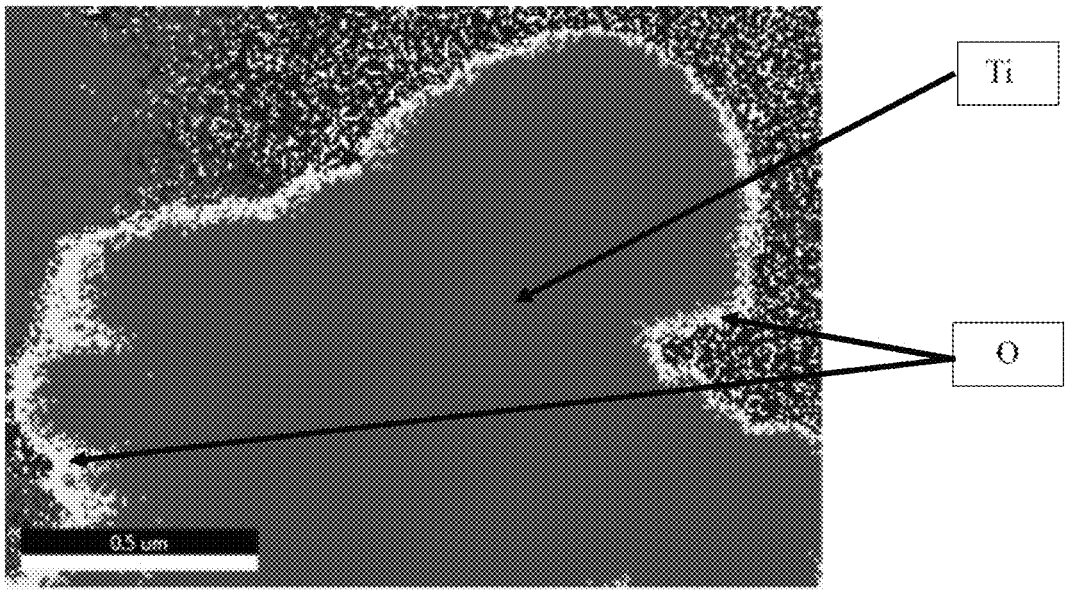

MgO coated Ti crystals are clearly observed in the EDX elemental mapping image shown in FIG. 16 at (a) while areas related to Mg are not observed in the product received after leaching with dilute HCl acid (FIG. 16 at (b)). Only a very thin layer of oxide is formed on the Ti crystal accounting for the presence of approximately 0.4% of oxygen in the EDX analysis.

An Example Process of Extracting Ti from Raw Rutile

Ilmenite ($FeTiO_3$), rutile ($TiO_2$), and leucoxene are the only naturally-occurring Ti bearing minerals that have been considered as suitable feedstock for either the Ti metal-producing or pigment industries. This is because only these minerals are found in large enough commercial concentrations; compared with other naturally occurring minerals comprising Ti.

The occurrence of mineral sands was first discovered in Sri Lanka mainly in the northeast coast of Pulmuddai in 1904. The minerals found in sand are ilmenite, rutile, zircon, Hi Ti ilmenite, monazite and garnet, which are all mixed in with ordinary sea sand (e.g., quartz). These minerals have uses in many industries ranging from paint pigment manufacture, paper, plastics, porcelain ware, aerospace and many others. Amongst these minerals, rutile shows the second largest commercial production as 9,000 tons per year according to the data reported by Lanka Mineral Sand Limited.

Even though, the annual production of rutile is less than that of ilmenite (90,000 tons per year), it is still important to develop a method to extract Ti from rutile, as it shows high percentage of $TiO_2$ (96%) compared to the percentage of $TiO_2$ in ilmenite (54%).

In the process of extracting Ti described above, which may be used for example to extract Ti from ilmenite sand, it was confirmed that structural iron present in ilmenite should be removed prior to carrying out the reduction process with Mg to obtain a Ti sponge. Although, the percentage of structural Fe in rutile sand is significantly lower than that of ilmenite, direct reduction of rutile with Mg was not possible. Therefore, this study mainly focuses on development of methods to extract Ti as a sponge from rutile as the raw material.

An Exemplary Process

Figure 17:
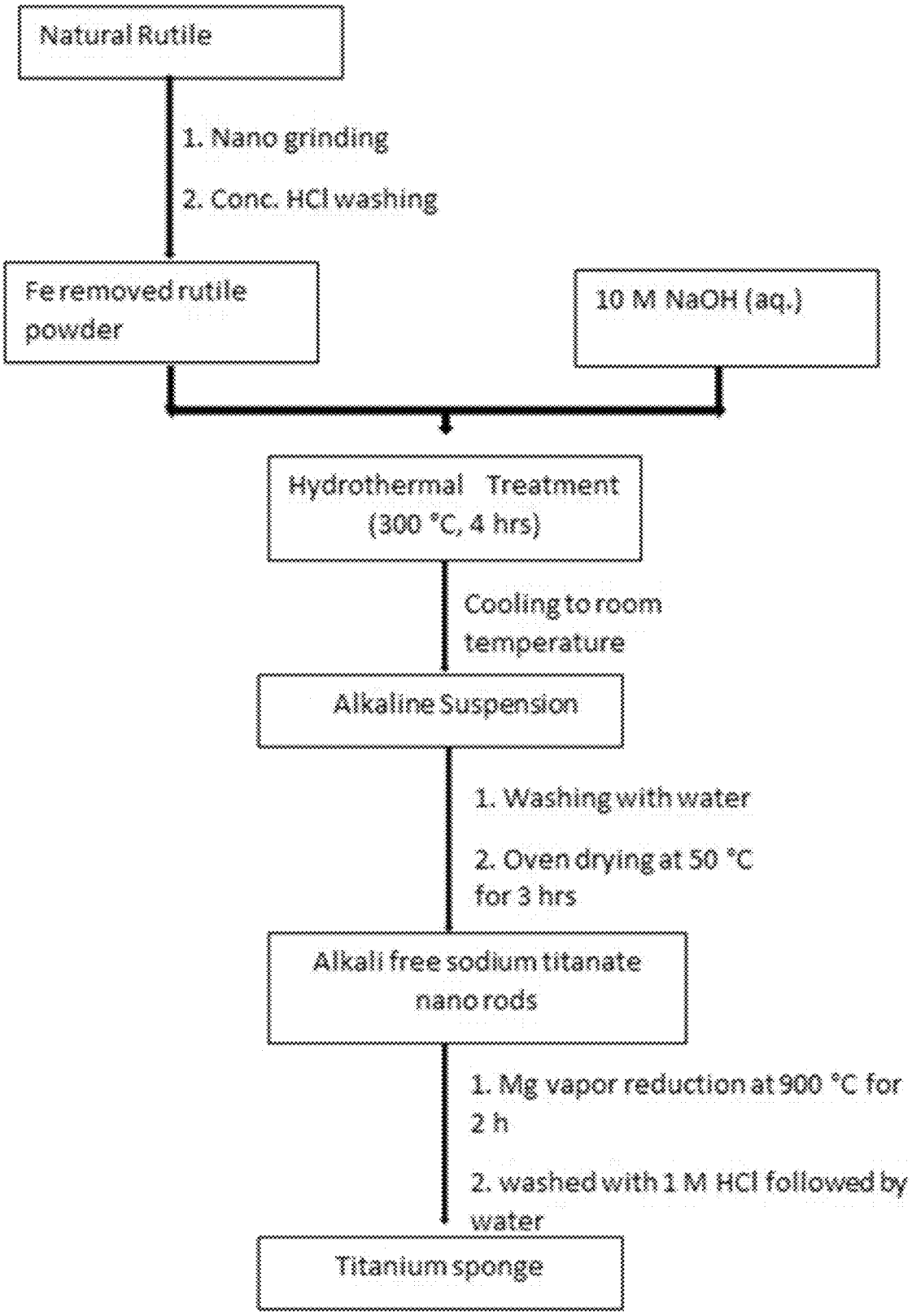
FIG. 17 provides a schematic diagram of the synthesis of Ti from natural rutile, according to an example embodiment.
Figure 17A:
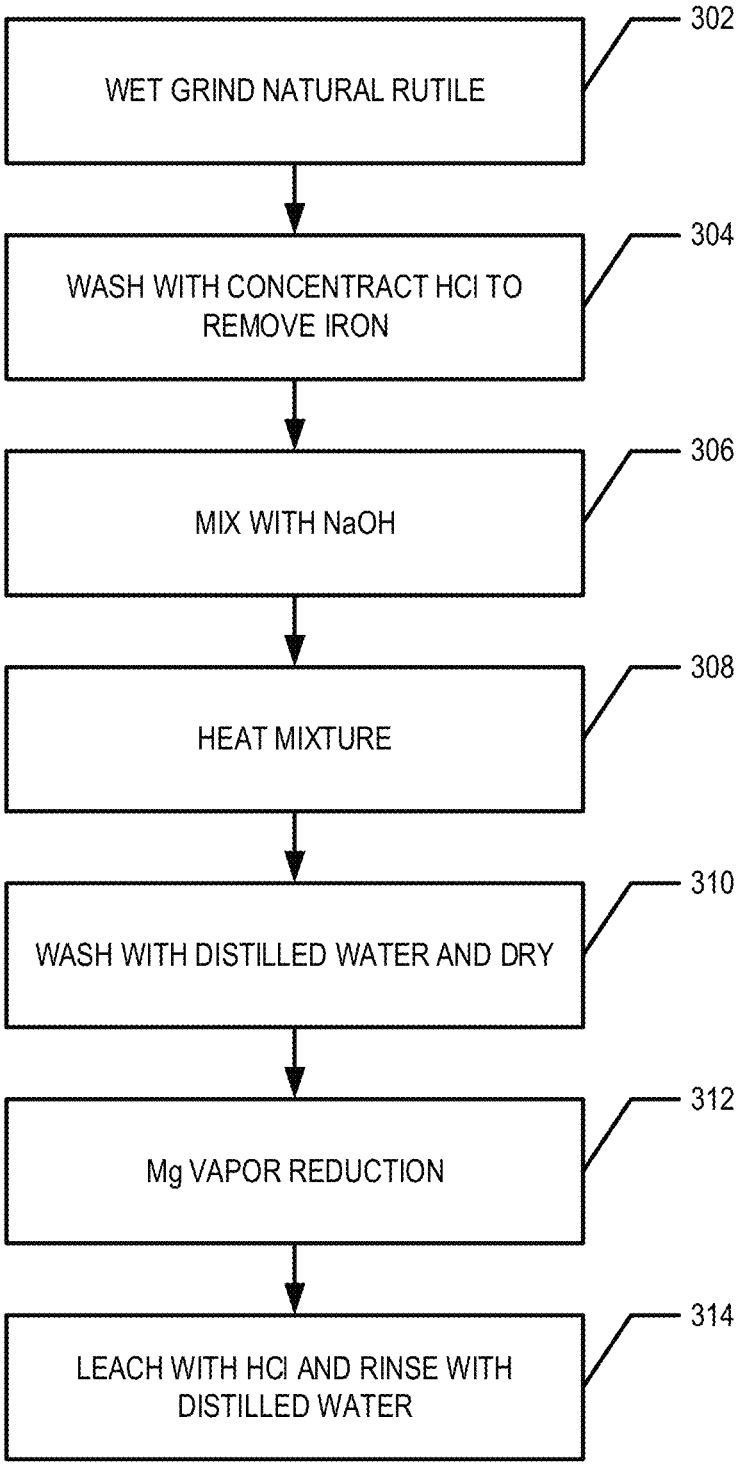
FIG. 17A provides a flowchart illustrating processes and procedures of an example embodiment of the Ti extraction process with raw rutile as the Ti source.

FIGS. 17 and 17A provide a flow diagram and a flowchart of an example process of extracting a Ti from a mineral and/or ore comprising Ti, such as, for example, raw and/or natural rutile, according to an example embodiment. In various embodiments, the mineral and/or ore comprising Ti is wet ground. In an example embodiment, natural rutile (e.g., approximately 10.0 g) was mixed with of distilled water (e.g., approximately 20 ml) and wet ground for 1 h (at block 302). In an example embodiment, the rutile and distilled water is wet ground using a FRITSCH planetary ball mill using 1 mm Zr balls. In an example embodiment, the wet ground mineral and/or ore is acid leached to remove iron impurities. For example, the ground rutile (10.0 g) is acid leached overnight (e.g., for approximately 8-15 h) with concentrated HCl (e.g., approximately 10 mL) to remove iron impurities (at block 304). The product is rinsed with distilled water to remove acid residues and dried at 50° C., for example. Samples were characterized using PXRD (Bruker D8 Focus) with Cu Kα (α=0.154 nm) irradiation at a scan rate of 0.02° $s^{-1}$ and a 2θ range of 5-90° and SEM (Hitachi SU 6000600) with accelerating voltages of 5-20 kV and EDX (Hitachi SU 6000600) with accelerating voltages of 20 kV (see, for example, FIG. 18).

In an example embodiment, at least a portion of the rutile (e.g., approximately 2.0 g) obtained by wet grinding, is mixed with 10 M NaOH (e.g., approximately 30 ml) solution to form a mixture and/or solution comprising Ti. For example, the acid leached, wet ground mineral and/or ore comprising Ti is mixed with a NaOH solution or other solution to form a mixture and/or solution comprising Ti. In an example embodiment, the solution used to form the mixture and/or solution comprising Ti is a basic solution. The mixture and/or solution comprising Ti is placed in a hydrothermal treatment vessel, such as, for example, a Teflon tube (at block 306). The mixture and/or solution comprising Ti mixture is then introduced to hydrothermal treatment by heating at approximately 300° C. for approximately 4 h under autogenous pressure (at block 308). The resulting product is cooled down to room temperature (e.g., approximately 18-30° C.). The resulting product may be actively or passively cooled in various embodiments. The cooled resulting product is washed with distilled water (e.g., 50 ml, three times) to remove base residues and then is dried at approximately 50° C. (at block 310). In an example embodiment, the product resulting from the hydrothermal treatment is sodium titanate. In various other embodiments, the product resulting from the hydrothermal treatment may vary based on the contents of the basic solution used to form the mixture and/or solution comprising Ti. In an example embodiment, the product resulting from the hydrothermal treatment is a crystalline and/or nanocrystal product, such as, for example, crystalline sodium titanate (e.g., sodium titanate nano rods).

In an example embodiment, the product resulting from the hydrothermal treatment is loaded onto a second non-corrosive tray 108. In an example, embodiment, the product resulting from the hydrothermal treatment is ground to form a powder and then loaded onto a second non-corrosive tray 108. For example, crystalline sodium titanate may be ground to form a powder and then loaded onto a second non-corrosive tray 108. In an example embodiment, nano crystals (e.g., sodium titanate nano rods) resulting from the hydrothermal treatment may be loaded onto a second non-corrosive tray 108. For example, a bed of approximately 2.0 g of sodium titanate was loaded onto a second non-corrosive tray 108 (e.g., a stainless steel tray) which was suspended over a bed of approximately 5.0 g of Mg powder loaded on a first non-corrosive tray 108 (e.g., a stainless steel tray). In an example embodiment, the Mg powder is used in excess. The trays 108 of sodium titanate and Mg power are placed in a non-corrosive reaction chamber 112 that is then sealed with a lid 104. In an example embodiment, the rim of the sealed container 112 was covered by a ceramic paste 114 to further seal the chamber. The sealed reaction chamber 112 was placed in a furnace and the chamber was saturated and/or filled with inert gas (e.g., Argon gas) via the inert gas inlet 102. In an example embodiment, the sealed reaction chamber 112 is heated to approximately 950° C. within the furnace (at block 312). The reaction is continued for approximately 2 h in an example embodiment. After the reaction has been continued for approximately 2 h, the inert gas is removed from the sealed reaction chamber 112 via an inert gas outlet (not shown) and the reaction chamber 112 is actively and/or passively cooled to room temperature (e.g., approximately 18-30° C.). In an example embodiment, the resulting product is leached overnight with dilute HCl (e.g., 1 M, 100 ml) to remove MgO (at block 314). The product is rinsed with distilled water to remove the acid residues and dried, for example, at approximately 50° C. For example, the reduction process may be similar to that described above with respect to FIGS. 2 and 2A.

Figure 18:
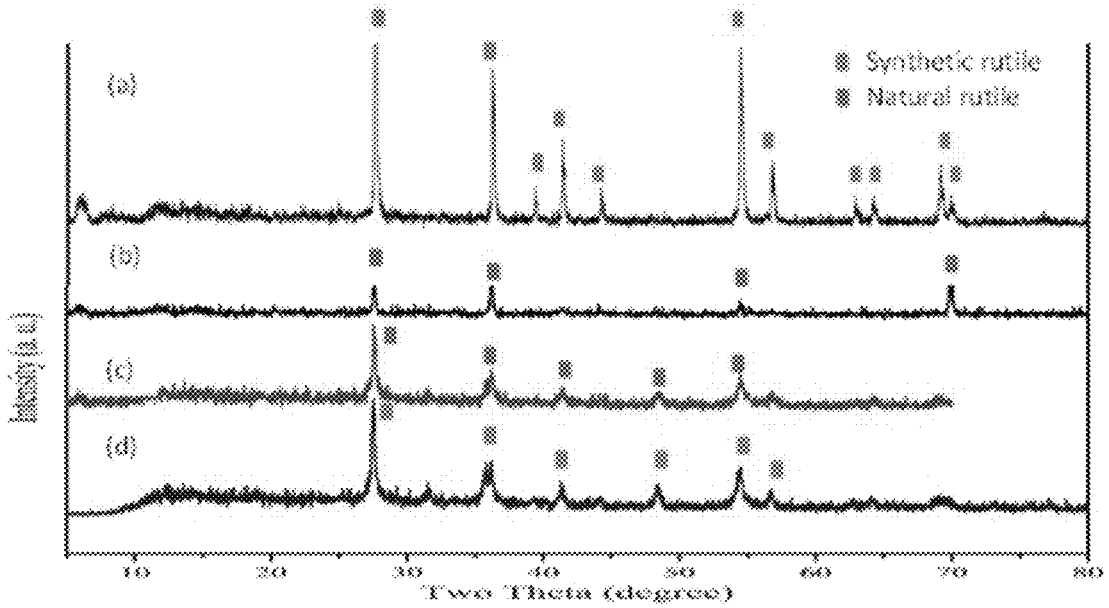
FIG. 18 shows powder X-ray diffraction patterns of (a) synthetic rutile ($TiO_2$), (b) natural rutile, (c) wet ground rutile and (d) wet ground and acid leached rutile, according to example embodiments.

FIG. 18 shows PXRD patterns of (a) synthetic rutile ($TiO_2$), (b) natural rutile, (c) wet ground rutile and (d) wet ground and acid leached rutile. The PXRD patterns of synthetic rutile, natural rutile, wet ground rutile and wet ground rutile after acid leaching are shown in FIG. 2. As shown in FIG. 2(*b*), the raw rutile does not show all the characteristic peaks related to synthetic rutile. However, it was observed that there is a tendency of relevant peaks to appear with the treatments, suggesting that structural change of natural rutile to synthetic rutile occurs with the removal of iron impurities during the grinding and acid treatment (FIG. 2(*d*)).

Figure 19:
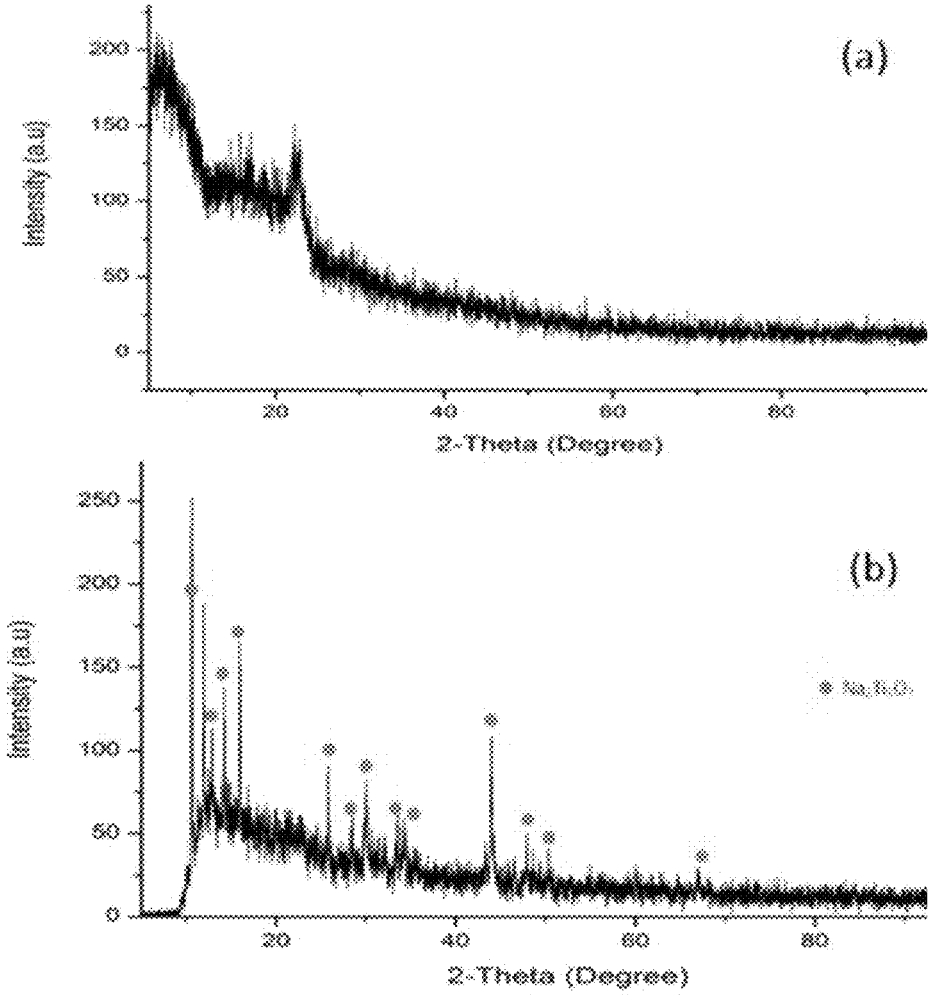
FIG. 19 shows powder X-ray diffraction patterns of (a) as-synthesized sodium titanate and (b) sodium titanate after calcination, according to an example embodiment.

FIG. 19 shows PXRD patterns of (a) as-synthesized sodium titanate and (b) sodium titanate after calcination. As shown in FIG. 19(*a*), the sodium titanate is in the amorphous form. In order to confirm the structure, the product was subjected to calcination. The PXRD pattern of the calcined product was matched with the crystalline structure of sodium titanate ($Na_2Ti_3O_7$). The absence of other peaks confirms that all the rutile has been converted into sodium titanate.

Figure 20:
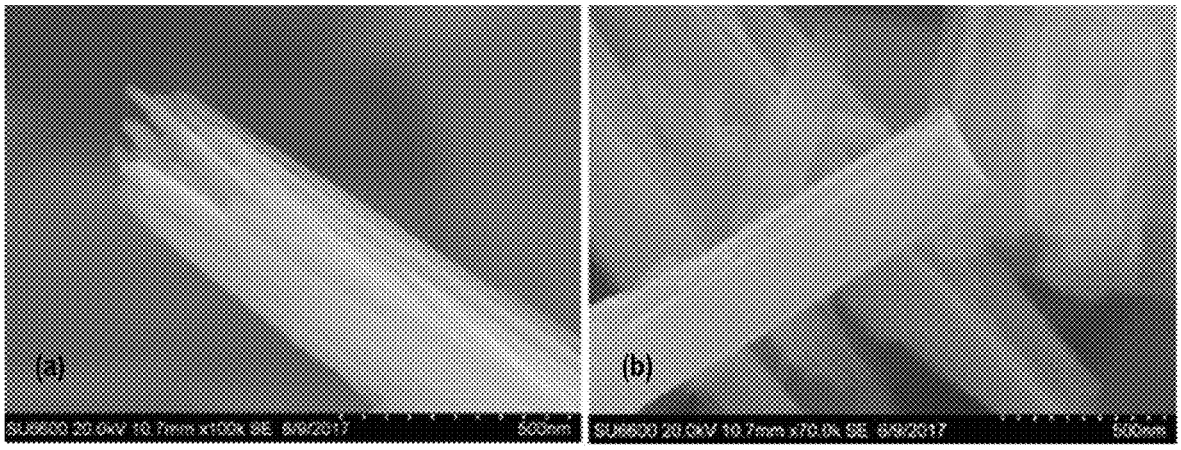
FIG. 20 shows scanning electron microscopy images of sodium titanate nano rods.
Figure 21:
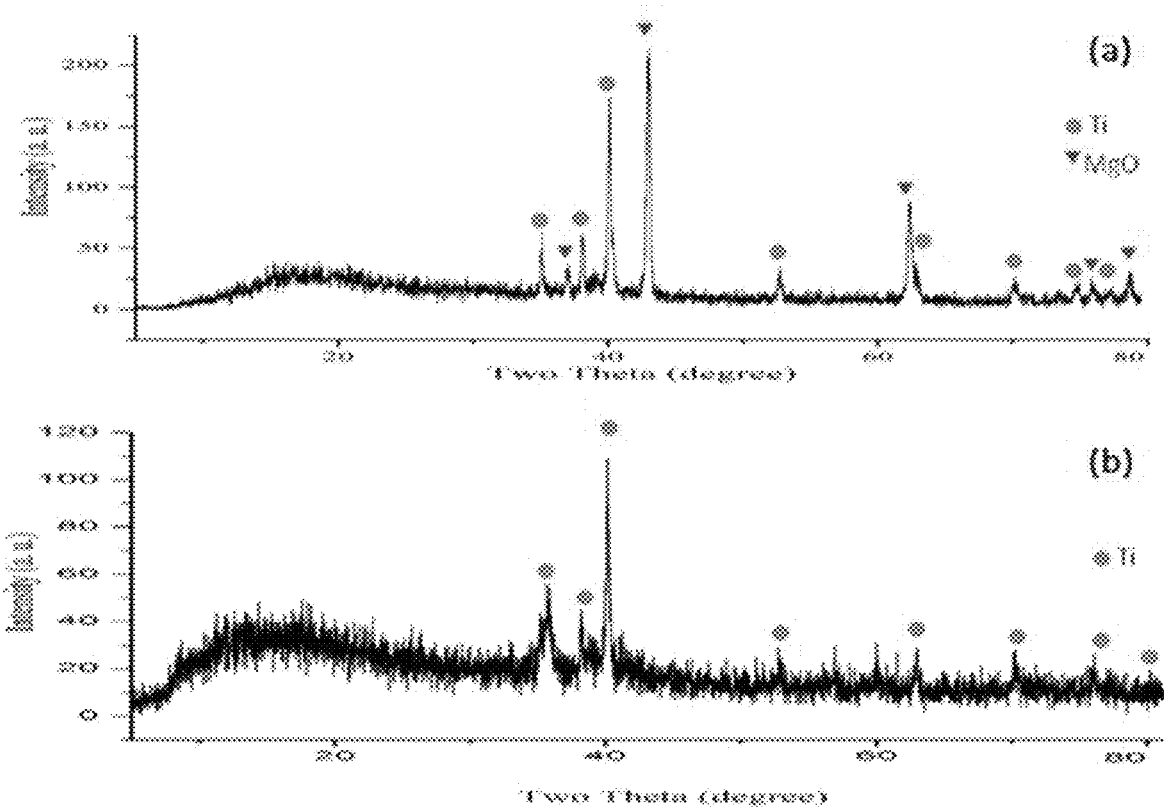
FIG. 21 shows powder X-ray diffraction patterns of the product (a) before leaching with acid and (b) after leaching with acid, according to an example embodiment.

FIG. 20 shows SEM images of sodium titanate nano rods. The SEM image of the sodium titanate shows rod like nano structures with the diameter less than 100 nm. PXRD pattern of Ti sponge before and after leaching with diluted HCl is shown in FIG. 21 at (a) and (b) respectively. The absence of peaks related to MgO in the PXRD diffractogram of acid leached Ti sponge (FIG. 21(*b*)) confirms the complete removal of MgO from the product as $MgCl_2$ (MgO (s)+Ti (s)+2HCl (aq)→Ti (s)+$MgCl_2$ (aq)+$H_2O$ (l)). Further, the absence of any peak related either to $TiO_2$ or sodium titanate confirms that the intermediate product (sodium titanate) has been successfully reduced to Ti during the reduction with Mg vapor.

Figure 22:
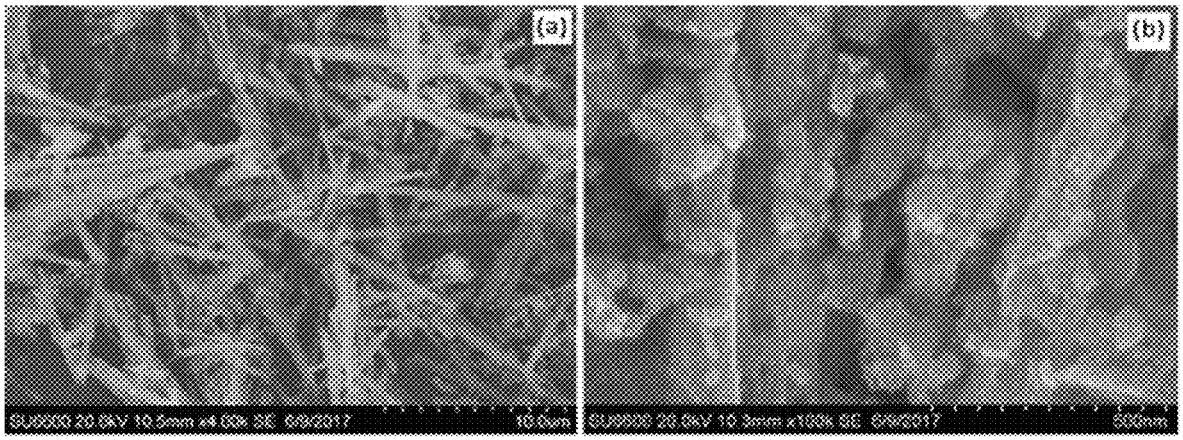
FIG. 22 shows scanning electron microscopy images of the product (a) prior to leaching with acid and (b) after leaching with acid, according to an example embodiment.
Figure 23:
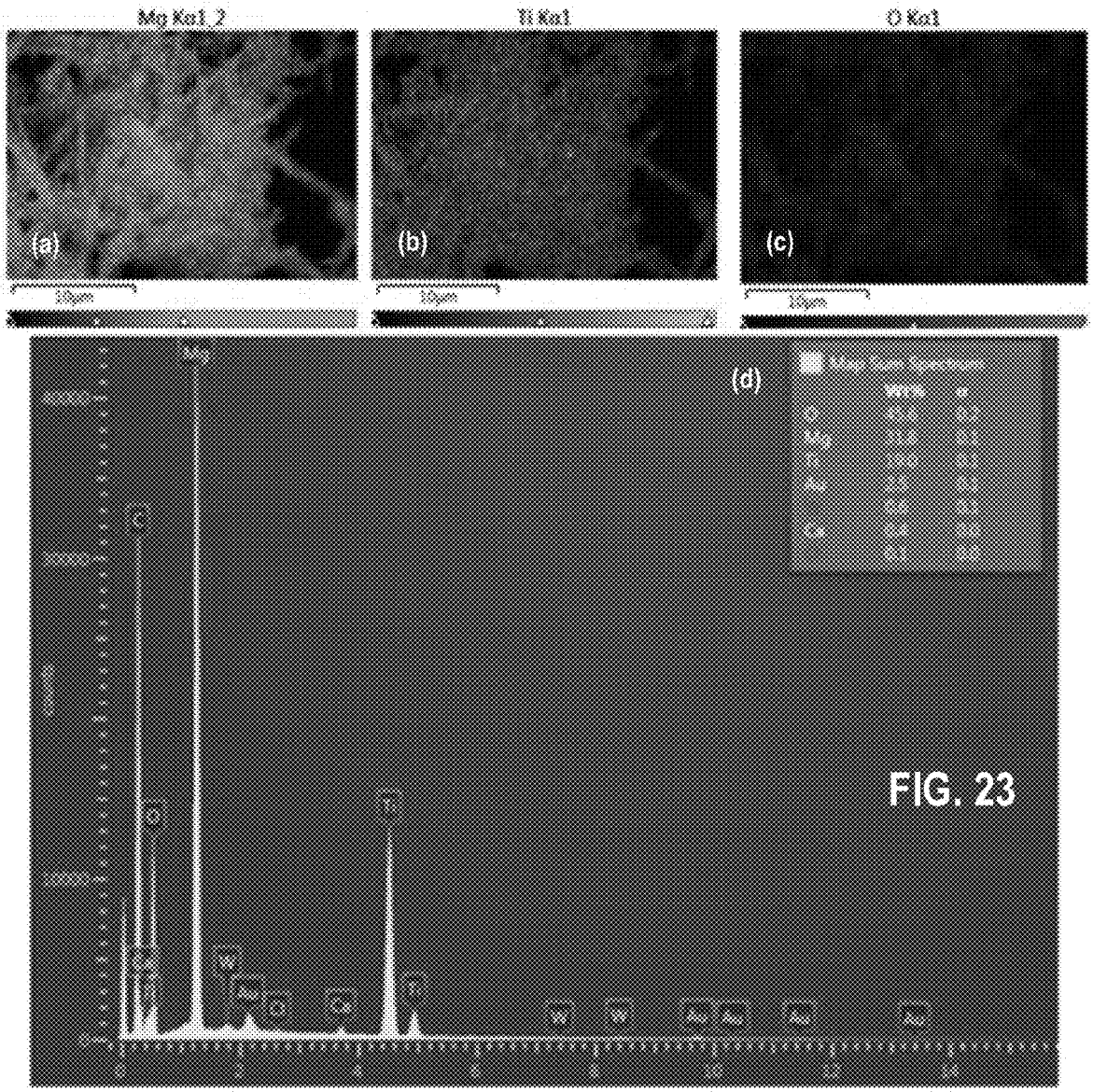
FIG. 23 shows energy dispersive X-ray mapping of titanium sponge before leaching with acid, according to an example embodiment.
Figure 24:
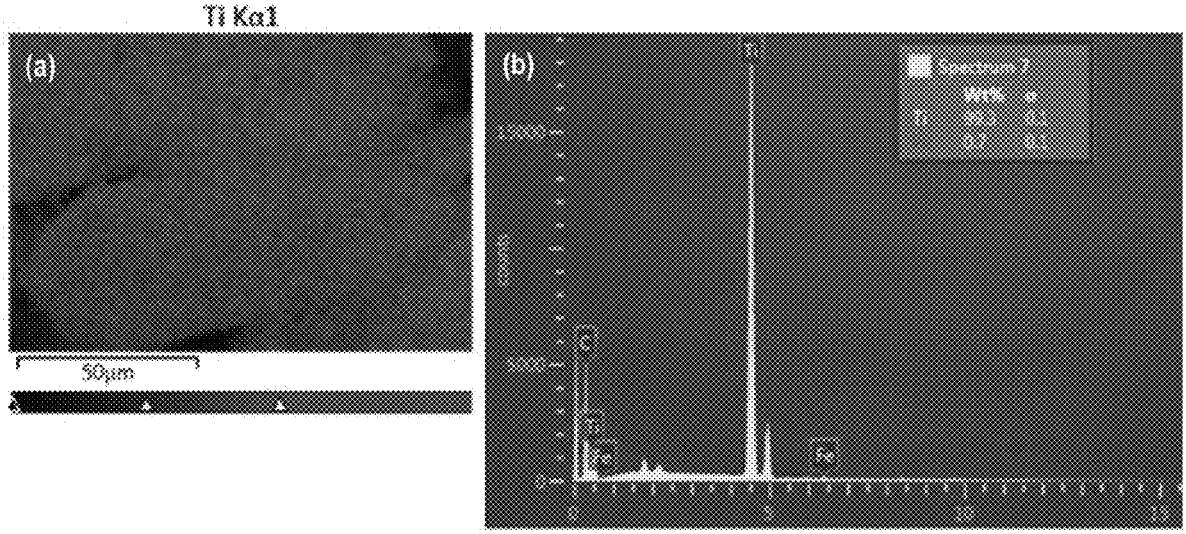
FIG. 24 shows energy dispersive X-ray mapping of titanium sponge after leaching with acid, according to an example embodiment.

FIG. 22 shows SEM images of the product (a) prior to leaching with HCl acid, (b) after leaching with HCl acid. FIG. 23 shows EDX mapping of Ti sponge before leaching with HCl acid. FIG. 24 shows EDX mapping of Ti sponge after leaching with HCl acid. The morphology of the product before leaching, as shown at FIG. 22 (*a*), shows a rod like structure with the deposition of MgO crystals on the surface of the rods. It is further confirmed by the EDX mapping of the Ti sponge before acid leaching (see FIG. 23). FIG. 22 (*b*) is representative of the pure nano sized Ti sponge. Further, the particle size of the product has reduced after leaching compared to the image taken before leaching. This indicates that MgO was produced as a layer over the produced Ti rods and has been washed away thorough the acid leaching step. The EDX mapping data of the acid leached Ti sponge (FIG. 24) further supports the conclusion as there are no other elements present as impurities other than some residual Fe, resulting in an average purity of 99% Ti in the sponge.

Extraction of 99% Ti from Sri Lankan rutile sand was successfully achieved by hydrothermal extraction of rutile followed by Mg vapor reduction technique as described herein.

Another Exemplary Process

Figure 25:
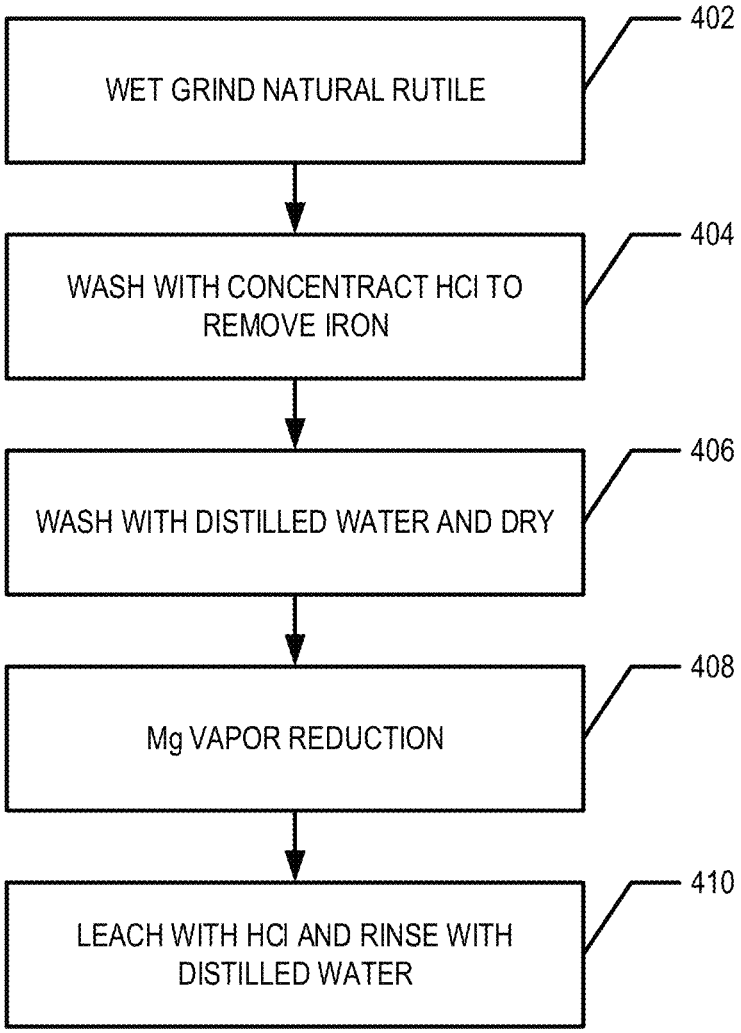
FIG. 25 provides a flowchart illustrating processes and procedures of another example embodiment of the Ti extraction process with raw rutile as the Ti source.

FIG. 25 provides a flowchart of another example process of extracting Ti from a mineral and/or ore comprising Ti, such as, for example, raw and/or natural rutile, according to an example embodiment. In an example embodiment, rutile sand is obtained (e.g., from Sri Lanka mineral sand Ltd, Sri Lanka) and a 37% HCl acid (Sigma-Aldrich analytical grade) may be used to wash the sand as initial step. In various embodiments, no further purifications are required prior to the process described herein.

In various embodiments, the mineral and/or ore comprising Ti is wet ground. In an example embodiment, natural rutile (e.g., approximately 10.0 g) was mixed with of distilled water (e.g., approximately 20 ml) and wet ground for 1 h (at block 402). In an example embodiment, the rutile and distilled water is wet ground using a FRITSCH planetary ball mill using 1 mm Zr balls. In an example embodiment, the wet ground mineral and/or ore is acid leached to remove iron impurities. For example, the ground rutile (10.0 g) is acid leached overnight (e.g., for approximately 8-15 h) with concentrated HCl (e.g., approximately 10 mL) to remove iron impurities (at block 404). The product is rinsed with distilled water to remove acid residues and dried at 50° C., for example (at block 406). Samples were characterized using powder X-ray diffractometer (Bruker D8 Focus) with Cu Kα (α=0.154 nm) irradiation at a scan rate of 0.02° $s^{-1}$ and a 2θ range of 5-90° and scanning electron microscopy (SEM, Hitachi SU 6000600), with accelerating voltages of 5-20 kV and energy dispersive X-ray spectrometer (EDX Hitachi SU 6000600) with accelerating voltages of 20 kV (see, for example, FIGS. 26-32).

In an example embodiment, the acid leached ground mineral or ore is loaded onto a second non-corrosive tray 108. For example, a bed of approximately 2.0 g of acid leached ground rutile was loaded onto a second non-corrosive tray 108 (e.g., a stainless steel tray) which was suspended over a bed of approximately 5.0 g of Mg powder loaded on a first non-corrosive tray 108 (e.g., a stainless steel tray). In an example embodiment, the Mg powder is used in excess. The trays 108 of sodium titanate and Mg power are placed in a non-corrosive reaction chamber 112 that is then sealed with a lid 104. In an example embodiment, the rim of the sealed container 112 was covered by a ceramic paste 114 to further seal the chamber. The sealed reaction chamber 112 was placed in a furnace and the chamber was saturated and/or filled with inert gas (e.g., Argon gas) via the inert gas inlet 102. In an example embodiment, the sealed reaction chamber 112 is heated to approximately 950° C. within the furnace (at block 408). The reaction is continued for approximately 2 h in an example embodiment. After the reaction has been continued for approximately 2 h, the inert gas is removed from the sealed reaction chamber 112 via an inert gas outlet (not shown) and the reaction chamber 112 is actively and/or passively cooled to room temperature (e.g., approximately 18-30° C.). In an example embodiment, the resulting product was subjected to ultrasound assisted bath leaching (e.g., for 30 min with ultrasound at a frequency of 40 kHz) with dilute HCl (e.g., 1 M, 100 ml) one or more times (e.g., three times) to remove magnesium oxide. The product was rinsed with distilled water to remove the acid residues and was dried at approximately 60° C., for example. For example, the reduction process may be similar to that described above with respect to FIGS. 2 and 2A.

The phase and crystallinity of the samples were analyzed by Powder X-ray Diffractometer (Bruker D8 Focus) with Cu Kα (λ=0.154 nm) irradiation in the 2θ range of 5-90° at a scanning rate of 0.020° $sec^{-1}$. The morphology and element content of the products were studied by Scanning Electron Microscopy (SEM, Hitachi SU 6000600), with accelerating voltages of 5-20 kV coupled with Energy Dispersive X-ray spectrometer (EDX). Transmission Electron Microscopic imaging (TEM, JEOL 2100, operating at 200 kV) were carried out for internal structure studies and the elemental compositions were studied at the nanoscale using Electron Energy Loss Spectroscopy (EELS) (Gatan 963 EELS spectrometer at 0.05 eV/channel dispersion). The sample was first dispersed in methanol using ultrasound sonication bath at room temperature for 30 min and a drop of the dispersion was dried on a carbon coated Cu grid prior to conduct TEM/EELS studies.

Figure 26:
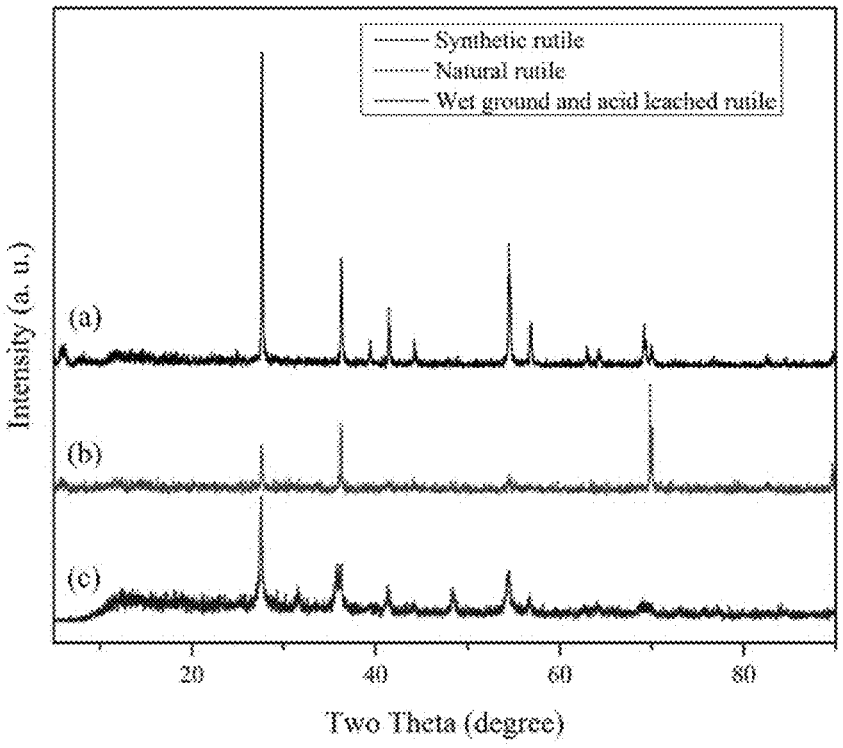
FIG. 26 shows powder X-ray diffraction patterns of (a) synthetic rutile ($TiO_2$), (b) natural rutile and (c) wet ground and acid leached rutile, according to an example embodiment.

The PXRD patterns of synthetic rutile, natural rutile and wet ground rutile after acid leaching are shown in FIG. 26. As shown by a comparison of FIG. 26(*a*) and FIG. 26(*b*), the natural rutile does not show all the characteristic peaks related to synthetic rutile. However, it was observed that there is a tendency of those peaks to be appeared with the treatments, suggesting that the structural changes of natural rutile to synthetic rutile occurs with the removal of iron impurities during the grinding and acid treatment (FIG. 26(*c*)).

Figure 27:
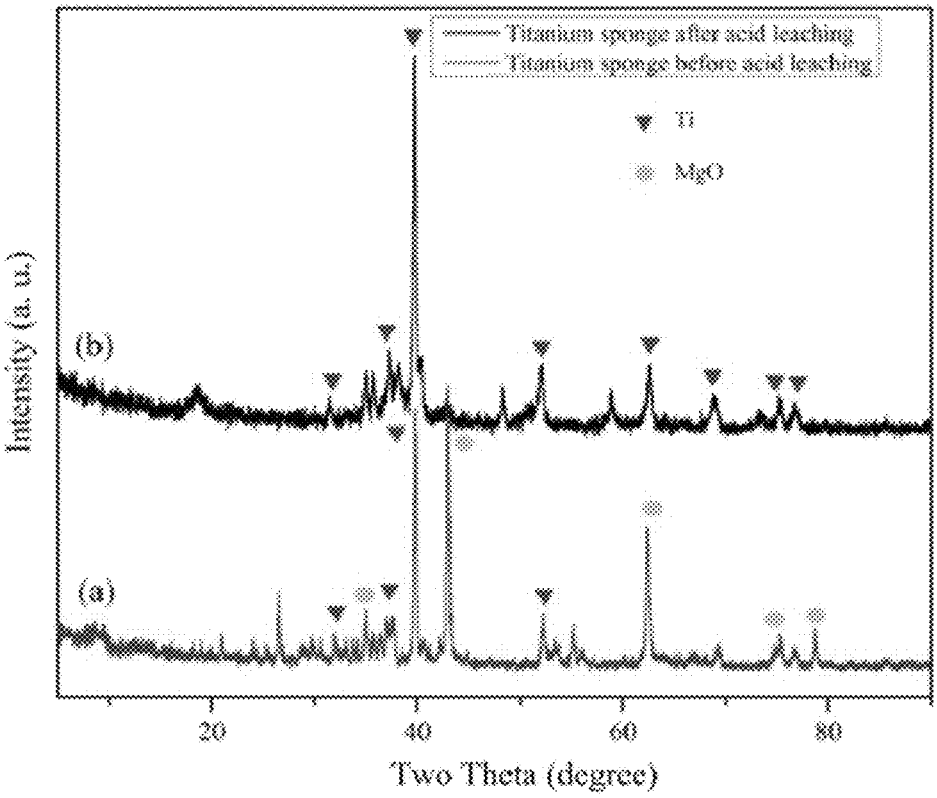
FIG. 27 shows powder X-ray diffraction patterns of Ti sponge (a) before acid leaching and (b) after acid leaching, according to an example embodiment.

The PXRD patterns of the products obtained after the reaction with Mg vapor at 950° C. for 2 h are shown in FIG. 27. The crystalline phases of both Ti and MgO were identified in the sample prior to leaching with acid (ICDD PDF number for Ti metal-44-1294 and MgO-4-829) as shown in FIG. 27(*a*), indicating that the rutile has been subjected to complete reduction by Mg vapor.

$$\text{Rutile(s)}+\text{Mg(g)}\rightarrow\text{Ti(s)}+\text{MgO(s)}$$

There is no evidence of formation of any mixed metal oxides, sub-oxides or alloys of Ti. FIG. 27(*b*) shows the product after leaching with acid followed by washing with distilled water. The presence of peaks corresponded only for pure Ti indicates that the MgO has been removed as $MgCl_2$ during the acid leaching and washing process.

$$\text{MgO(s)}+\text{Ti(s)}+2\text{HCl(aq)}\rightarrow\text{Ti(s)}+\text{MgCl}_2\text{(aq)}+\text{H}_2\text{O(l)}$$

The SEM images of (a) natural rutile (b) synthetic rutile and (c) ground and acid leached natural rutile is shown in FIG. 28. As shown in FIG. 28, natural rutile shows granular morphology with the particle size less than 500 μm. However, the particle size and the morphology of natural rutile became similar to that of synthetic rutile during the grinding followed by the acid leaching.

SEM image of the product obtained after the reduction with Mg vapor shown in FIG. 29. The Ti sponge before acid leaching shows a plate-like morphology as shown in FIG. 29(*a*), indicating the presence of MgO crystals over the Ti particles. When MgO has been leached out by the diluted HCl acid leaching process, the morphology has changed rapidly. As shown in FIG. 29(*b*), the particles comprise an irregular shaped morphology and specially a porous structure with the particle size ranging from 100-400 nm. The porous morphology of the particle surface might be due to the removal of surface bound MgO layer during the acid leaching and washing process.

Figure 30:
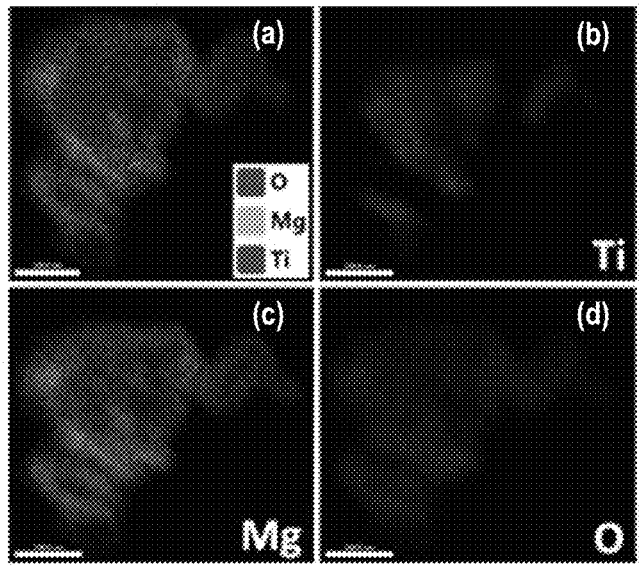
FIG. 30 shows energy dispersive X-ray diffraction results of Ti sponge before leaching with dilute HCl acid, wherein (a) shows the combined results for Ti, Mg, and O in the Ti sponge, (b) shows the results for Ti in the Ti sponge, (c) shows the results for Mg in the Ti sponge, and (d) shows the results for O in the Ti sponge, according to an example embodiment.
Figure 31:
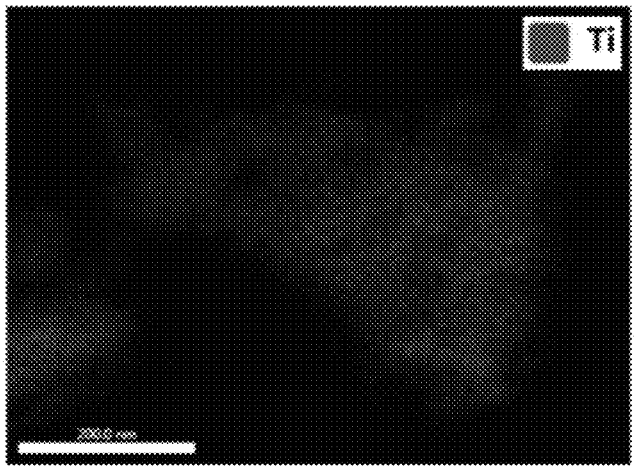
FIG. 31 shows energy dispersive X-ray diffraction results of Ti sponge after leaching with dilute HCl acid, according to an example embodiment.

Energy Dispersive X-Ray Diffraction results of the resulted Ti sponge before and after leaching with HCl acid also provide enough evidence to prove the removal of MgO impurities from the Ti sponge during the leaching process, as the EDX mapping of Ti sponge before acid leaching contains Ti, Mg and O (see FIG. 30). Further, according to the EDX results shown in FIG. 30(*a*), the Ti oxides in rutile reacted with Mg vapor before leaching with dilute HCl acid indicating the presence of Ti in the core of the particle and Mg and O as a coating around the Ti core. It suggests that the Ti sponge obtained after reducing rutile with Mg vapor results in a coreshell product in which the Ti particles are covered with an MgO layer.

Nevertheless, the absence of any other elements but the Ti in the EDX mapping of Ti sponge after leaching with HCl acid (see FIG. 31) is in agreement with the total removal of MgO impurities during the final dilute HCl acid treatment followed by the washing.

Figure 32:
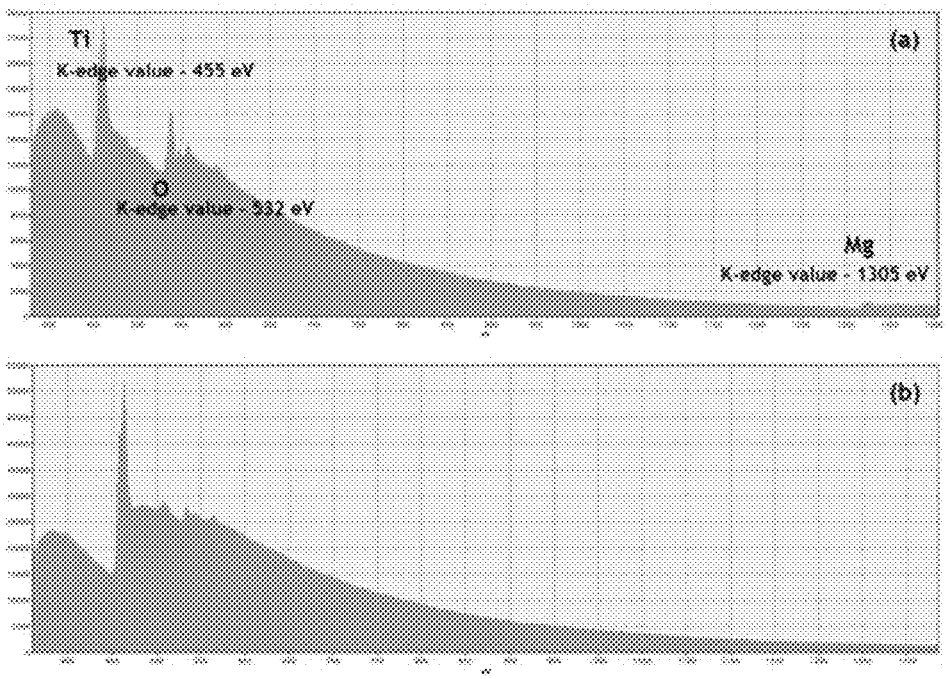
FIG. 32 shows electron energy loss spectroscopy results of titanium sponge (a) before leaching with dilute HCl acid showing Ti, O and Mg edges and (b) after leaching with dilute HCl acid showing only Ti edges, according to an example embodiment.

FIG. 32 shows the EELS results of Ti sponge before and after leaching with dilute HCl acid. According to the EELS results, the characteristic edges for Ti, O and Mg were appeared at K-edge values at 455 eV, 532 eV and 1305 eV respectively, which confirms that the only elements present in the Ti sponge prior to acid leaching is Ti, Mg and O (see FIG. 7(*a*)). Thus, the EELS results provide further evidence to prove that the Mg vapor results in a coreshell product where the Ti particles are covered with MgO layer, which is elucidated in FIG. 6. Interestingly in FIG. 7(*b*), the Mg edge at 1305 eV is totally disappears while remaining the Ti edge unchanged, which is again indicating the removal of MgO during the acid leaching and washing process as described previously under the FIG. 31.

Finally, by considering all the observations and analysis data, it can be concluded that the synthesis of pure Ti sponge by simple reduction process with Mg vapor has been successfully achieved from natural rutile sand.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent presently preferred embodiments of the invention and are therefore representative of the subject matter broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A method of producing titanium metal from a titanium comprising mineral, the method comprising:

acid leaching the titanium comprising mineral;

mixing the acid leached titanium comprising mineral with an aqueous solution of NaOH;

heating a mixture of the acid leached titanium comprising mineral and the aqueous solution of NaOH to extract a titanium comprising compound from the mixture using a hydrothermal treatment, wherein the titanium comprising compound is supplied to the reaction vessel;

providing at least a portion of the titanium comprising compound in a reaction vessel;

providing a composition comprising an Mg source in the reaction vessel;

heating the reaction vessel to an internal temperature of between 850° C. and 1000° C. until a vapor of Mg is produced for at least 30 minutes to form a reaction product; and washing said reaction product with one or more washing media to form a washed titanium reaction product.

2. The method of claim 1 further comprising wet nanogrinding the titanium comprising mineral prior to acid leaching the titanium comprising mineral.

3. The method of claim 1, wherein the hydrothermal treatment comprises heating the mixture within a hydrothermal treatment vessel to a temperature between 250° C. and 500° C. for at least 2 hours to cause formation of a crystalline titanium compound.

4. The method of claim 3, wherein the hydrothermal treatment comprises heating the mixture within the hydrothermal treatment vessel to a temperature of approximately 300° C. for approximately four hours.

5. The method of claim 1 wherein the composition comprising the Mg source comprises Mg powder.

6. The method of claim 5 wherein the Mg powder comprises Mg nanopowder.

7. The method of claim 1 wherein the reaction vessel is heated to an internal temperature of between 850° C. and 1000° C. for about 2 hours to form a reaction product.

8. The method of claim 1 wherein the reaction vessel is heated to an internal temperature of about 900° C. for about 2 hours to form a reaction product.

9. The method of claim 1 wherein the one or more washing media are selected from the group consisting of HCl, $HNO_3$, $H_2SO_4$ and deionized water.

10. The method of claim 1 wherein the method further comprises providing inert gas in said reaction vessel.

11. The method of claim 10 wherein said inert gas is argon.

12. The method of claim 1 wherein the reaction vessel contains a first tray upon which the titanium comprising compound source is placed and a second tray upon which the Mg source is placed.

13. The method of claim 12 wherein one or both of the first tray and second tray are vibrated while the reaction vessel is heated.

14. The method of claim 1 wherein the mixture is contained within a hydrothermal treatment vessel during the hydrothermal treatment.

15. The method of claim 14, wherein the hydrothermal treatment vessel is a Teflon tube.

16. The method of claim 1 wherein ultrasound sonication was used during at least a portion of the washing of the reaction product with the one or more washing media.

17. The method of claim 16 wherein the ultrasound sonication was used for approximately 2-5 minutes during the washing of the reaction product with the one or more washing media.

18. The method of claim 16 wherein the ultrasound sonication was used for approximately 30 minutes during the washing of the reaction product with one or more washing media.

19. A method of producing titanium metal from raw rutile comprising:

acid leaching the rutile to form an iron-leached out titanium comprising mineral;

mixing the iron-leached out titanium comprising mineral with an aqueous solution of NaOH;

heating a mixture of the iron-leached out titanium comprising mineral and the aqueous solution of NaOH to extract a titanium comprising compound from the mixture using a hydrothermal treatment, wherein the titanium comprising compound is supplied to the reaction vessel;

providing the titanium comprising compound in a reaction vessel under inert conditions;

providing a composition comprising Mg in the reaction vessel;

heating the reaction vessel to an internal temperature of between 850° C. and 1000° C. until a vapor of Mg is produced for at least 30 minutes to form a reaction product; and washing said reaction product with one or more washing media.

* * * * *